US006422183B1

(12) United States Patent
Kato

(10) Patent No.: US 6,422,183 B1
(45) Date of Patent: Jul. 23, 2002

(54) OIL INJECTION LUBRICATION SYSTEM AND METHODS FOR TWO-CYCLE ENGINES

(75) Inventor: Masahiko Kato, Hamamatsu (JP)

(73) Assignee: Sanshin Kogyo Kabushiki Kaisha, Hamamatsu (JP)

( * ) Notice: Subject to any disclaimer, the term of this patent is extended or adjusted under 35 U.S.C. 154(b) by 0 days.

(21) Appl. No.: 09/440,410

(22) Filed: Nov. 15, 1999

(30) Foreign Application Priority Data

Nov. 13, 1998 (JP) ..... 10-323257

(51) Int. Cl.[7] ..... F02B 33/04
(52) U.S. Cl. ..... 123/73 AD
(58) Field of Search ..... 123/73 AD

(56) References Cited

U.S. PATENT DOCUMENTS

| | | | | |
|---|---|---|---|---|
| 4,708,674 A | | 11/1987 | Matsumoto | |
| 5,235,944 A | | 8/1993 | Adachi | |
| 5,287,833 A | | 2/1994 | Yashiro | |
| 5,297,511 A | | 3/1994 | Suzuki | |
| 5,355,851 A | * | 10/1994 | Kamiya | 123/196 R |
| 5,390,635 A | * | 2/1995 | Kidera et al. | 123/196 R |
| 5,511,524 A | | 4/1996 | Kidera et al. | |
| 5,630,383 A | | 5/1997 | Kidera et al. | |
| 5,829,401 A | | 11/1998 | Masuda | |

FOREIGN PATENT DOCUMENTS

JP 06-231584 9/1994

OTHER PUBLICATIONS

Patents Abstracts of Japan—Abstract for above–referenced Japanese Application No. 06–231584.

* cited by examiner

*Primary Examiner*—Tony M. Argenbright
*Assistant Examiner*—Katrina B. Harris
(74) *Attorney, Agent, or Firm*—Knobbe Martens Olson & Bear LLP

(57) ABSTRACT

The present invention provides an improved oil injection lubrication system for two-cycle engines. The system includes a variable output oil pump, the output of which can be varied in relation to the throttle level. The system also includes a solenoid valve unit containing a plurality of solenoid valves that regulate the flow of oil from the oil pump to each cylinder. The electronic control unit sends control signals to the solenoid valve unit to regulate the flow of oil based upon factors relating to the operation of the engine in accordance with a control scheme. The factors may include those that apply to all of the engine's cylinders (i.e., do not vary between the cylinders), such as intake air temperature, atmospheric pressure, battery voltage, engine break-in period, and load frequency among others.

29 Claims, 25 Drawing Sheets

#1

#2

ThΘ

| | | | | |
|---|---|---|---|---|
| 1.0 | 1.0 | 1.0 | 1.0 | 1.0 |
| 1.0 | 1.0 | 1.0 | 1.0 | 0.95 |
| 1.0 | 1.0 | 1.0 | 1.0 | 0.95 |
| 1.0 | 1.0 | 1.0 | 0.95 | 0.95 |
| 1.0 | 1.0 | 0.95 | 0.95 | 0.95 |

rpm

#3

ThΘ

| | | | | |
|---|---|---|---|---|
| 1.0 | 0.95 | 1.0 | 1.1 | 1.15 |
| 1.0 | 0.95 | 1.0 | 1.1 | 1.15 |
| 1.0 | 1.0 | 1.0 | 1.0 | 0.95 |
| 1.0 | 1.0 | 1.0 | 0.95 | 0.95 |
| 1.0 | 1.0 | 0.95 | 0.95 | 0.95 |

rpm

#4

ThΘ

| | | | | |
|---|---|---|---|---|
| 1.0 | 0.95 | 1.0 | 1.1 | 1.15 |
| 1.0 | 0.95 | 1.0 | 1.1 | 1.15 |
| 1.0 | 1.0 | 1.0 | 1.0 | 0.9 |
| 1.0 | 1.0 | 1.0 | 0.9 | 0.9 |
| 1.0 | 1.0 | 0.9 | 0.9 | 0.9 |

rpm

#5

ThΘ

| | | | | |
|---|---|---|---|---|
| 1.0 | 0.9 | 0.95 | 1.05 | 1.2 |
| 1.0 | 0.9 | 0.95 | 1.05 | 1.2 |
| 1.0 | 1.0 | 1.0 | 1.0 | 0.9 |
| 0.95 | 0.95 | 0.95 | 0.9 | 0.9 |
| 0.9 | 0.95 | 0.9 | 0.9 | 0.9 |

rpm

#6

ThΘ

| | | | | |
|---|---|---|---|---|
| 1.0 | 0.9 | 0.95 | 1.05 | 1.2 |
| 1.0 | 0.9 | 0.95 | 1.05 | 1.2 |
| 1.0 | 1.0 | 1.0 | 1.0 | 0.85 |
| 0.85 | 0.85 | 0.85 | 0.85 | 0.85 |
| 0.8 | 0.85 | 0.85 | 0.85 | 0.85 |

rpm

OIL INJECTION LUBRICATION SYSTEM AND METHODS FOR TWO-CYCLE ENGINES

PRIORITY INFORMATION

This application is based on and claims priority to Japanese Patent Application No. 10-323257, filed Nov. 13, 1998, the entire contents of which is hereby expressly incorporated by reference.

BACKGROUND OF THE INVENTION

1. Field of the Invention

The present invention relates to oil injection lubrication for engines, and more particularly to an oil injection system and methods for lubricating a multiple cylinder two-cycle engine.

2. Description of the Related Art

For two-cycle engines, it is a common practice to mix lubricating oil with induction air to lubricate engine parts. Conventional systems typically mix oil with induction air in the same proportion regardless of engine speed. Under certain conditions, however, some cylinders of some engines require more lubricating oil than other cylinders. In multiple cylinder engines the temperature of the cylinders may differ from one another possibly due to differences in the cooling system capacity. These variations in temperature necessitate variations in the amount of lubricating oil delivered to the different cylinders. Typical oil injection systems deliver the same amount of oil to each cylinder regardless of the engine operating conditions. Operating conditions such as cylinder resting periods, idling periods, rapid acceleration periods, or continuous speed periods, however, often result in variations in the appropriate amount of oil required for each cylinder. In addition, variations in the lengths of exhaust runners for each cylinder of a two-cycle engine cause variations in the volumetric flow through each cylinder.

Typical outboard marine engines also have a vertically disposed crankshaft, which causes lubricating oil to descend from the upper cylinders to the lower cylinders. This orientation further exacerbates the differential in lubrication needs between the cylinders.

Conventional systems do not provide the capability of adjusting the amount of oil delivered to each cylinder to compensate for these situations. Consequently, conventional systems suffer from problems such as smoke generated by the mixture of air and lube oil, odor, and heavy oil consumption.

Existing systems for single cylinder engines provide a solenoid valve at a discharge side of a mechanical oil pump through which oil delivery can be regulated in response to varying engine operating conditions. In these systems, however, the oil pump is typically configured to supply oil at a constant volume per crankshaft revolution. At extremely low engine speeds, an engine may require much less oil per revolution than at higher speeds. As a consequence, the solenoid valves may have to be actuated in a relatively heavy duty cycle to appropriately regulate the flow of oil at low engine speeds. Actuation of the solenoid valves draws electrical power. Consequently these systems adversely draw a relatively large amount of electrical power during low engine speed periods when it is also more difficult to generate electrical power. Still another disadvantage of existing systems is that they would require a complicated layout of solenoid valves and lines in order to be adapted to multiple cylinder engines.

SUMMARY OF THE INVENTION

The present invention provides an improved oil injection lubrication system and associated methods for an engine, which has particular application in connection with a multi-cylinder engine.

In accordance with one aspect of the present invention, the system comprises a variable output oil pump, the output of which can be varied in relation to a throttle valve position. A solenoid valve unit, which includes a plurality of solenoid valves, regulates the flow of oil from the oil pump to each cylinder. An electronic control unit sends control signals to the solenoid valve unit to regulate the flow of oil based upon engine operating conditions in accordance with a control scheme. By adjusting the output from the oil pump in accordance with the throttle position, the volume of oil directed to each cylinder is roughly equal (i.e., approximates) to a predetermined volume of oil required or desired for a given engine speed or operational condition. The solenoid valve unit then regulates the volume flow to each cylinder through the solenoid valves to fine tune the amount of oil delivered to each cylinder (including both the combustion chamber and the corresponding crankcase section) to more precisely equal the predetermined volume, that volume depending upon the engine's running condition.

In a preferred mode, one solenoid valve is dedicated to each cylinder. The valve circuitry is configured to permit oil flow from the oil pump to the cylinders when the corresponding solenoid valves are in an inactive state. An electronic control unit (ECU) powers the solenoid valves to temporarily close the valves and direct a portion of the lubricant flow away from the cylinders (e.g., through a line to an oil tank). By varying the closure times of the valves, the ECU can finely tune the amount of oil delivered to each cylinder in accordance with predetermined control strategies.

In accordance with this aspect of the present invention, a lubrication system is provided for an engine having a plurality of cylinders. The system comprises a plurality of oil supply pipes, each oil supply pipe being configured to supply oil to one of the plurality of cylinders. A solenoid valve unit is connected to the plurality of oil supply pipes and regulates the flow of oil to the cylinders. An oil pump is connected to the solenoid valve unit to supply oil to the unit, and an electronic control unit is connected to and communicates with the solenoid valve unit to control the operation of the unit.

In one mode, an oil supply pipe carries a flow of oil from the valve unit to a vapor separator tank for mixture with the fuel supply in order to reduce the formation of deposits on fuel injectors, lubricate the fuel system, and/or prevent corrosion.

A preferred method of controlling oil delivery to the cylinders of an engine comprises producing a base volume flow of oil per crankshaft revolution. The base volume is adjusted per crankshaft revolution to deliver an adjusted volume per crankshaft revolution. This adjusted volume is then fine tuned for each cylinder.

In a preferred mode of operation, the base volume per crankshaft revolution is supplied through a positive displacement oil pump, and the base volume per crankshaft revolution is adjusted by varying the volume output per revolution by the positive displacement oil pump. The volume supplied per revolution by the positive displacement oil pump is preferably adjusted in relation to a position of a throttle valve of the engine. The adjusted volume is then fine tuned by passing the adjusted volume through a solenoid valve. The ECU preferably fine tunes the adjusted volume based on a number of factors relating to the operation of the engine. The factors may include those that apply to all of the engine's cylinders (i.e., do not differ between the cylinders), such as intake air temperature, atmospheric pressure, battery voltage, engine break-in period, and load frequency among others. The factors may also include those that differ between the cylinders, such as cylinder resting periods, different combustion efficiency due to exhaust runner length differences, different cylinder cooling capacities, and oil leak down from upper cylinders to lower cylinders, among other factors.

In one mode, the ECU determines a fine tuning of a first cylinder based upon at least one factor that applies to all of the cylinders. The ECU then determines the fine tuning of the additional cylinders based upon at least one factor that differs between the cylinders. The ECU preferably uses a compensation control map to adjust the oil supply for each of the remaining cylinders.

Further aspects, features and advantages of the present invention will become apparent from the detailed description of the preferred embodiment which follows.

BRIEF DESCRIPTION OF THE DRAWINGS

The above-mentioned and other features of the invention will now be described with reference to the drawings of preferred embodiments of the present watercraft. The illustrated embodiments are intended to illustrate, but not to limit the invention. The drawings contain the following figures.

DETAILED DESCRIPTION OF THE PREFERRED EMBODIMENTS OF THE INVENTION

In the following description, reference is made to the accompanying drawings, which form a part of this written description of the invention, and which show, by way of illustration, specific embodiments in which the invention can be practiced. It is to be understood that other embodiments may be utilized and structural changes may be made without departing from the scope of the present invention. Where possible, the same reference numbers will be used throughout the drawings to refer to the same or like components. Numerous specific details are set forth in order to provide a thorough understanding of the present invention. However, it will be obvious to one skilled in the art that the present invention may be practiced without the specific details or with certain alternative equivalent devices and methods to those described herein. In other instances, well-known methods, procedures, components, and devices have not been described in detail so as not to unnecessarily obscure aspects of the present invention.

Figure 1:
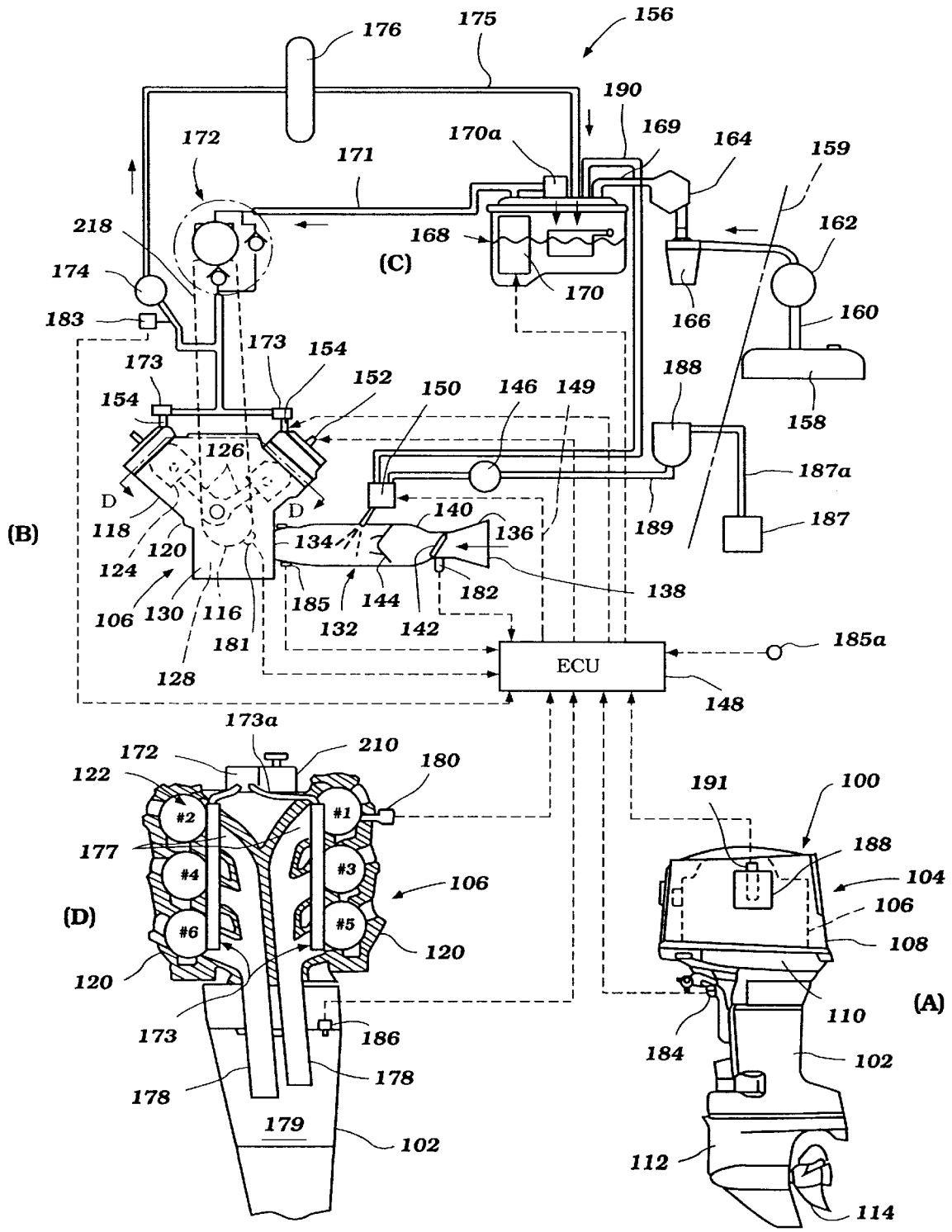
FIG. 1 is a schematic view of an engine control system, which is configured in accordance with a preferred embodiment of the present invention as employed on an outboard motor, and illustrates in Section A the outboard motor from a side elevational view, illustrates in Sections B and C a partial schematic view of the engine with associated portions of the oil injection system, illustrates in Section D a sectional view of the engine (as taken along line D—D of the Figure Section B) and a drive shaft housing of the outboard motor, and illustrates an electronic control unit (ECU) of the engine control system communicating with various sensors and controlled components of the engine.

In FIG. 1, Section A, an outboard motor constructed and operated in accordance with a preferred embodiment of the invention is depicted in side elevational view and is identified generally by the reference numeral 100. The entire outboard motor 100 is not depicted in that the swivel bracket and the clamping bracket, which are associated with the drive shaft housing, indicated generally by the reference numeral 102, are not illustrated. These components are well known in the art, and thus, the specific method by which the outboard motor 100 is mounted to the transom of an associated watercraft is not necessary to permit those skilled in the art to understand or practice the invention.

The outboard motor 100 includes a power head, indicated generally by the reference numeral 104. The power head 104 is positioned above the drive shaft housing 102 and includes a powering internal combustion engine, indicated generally by the reference numeral 106. The engine 106 is shown in more detail in the remaining three views of FIG. 1 and will be described shortly by reference thereto.

The power head 104 is completed by a protective cowling formed by a main cowling member 108 and a lower tray 110. The main cowling member 108 is detachably connected to the lower tray 110. The lower tray 110 encircles an upper portion of the drive shaft housing 102 and a lower end of the engine 106.

Positioned beneath the drive shaft housing 102 is a lower unit 112 in which a propeller 114, which forms the propulsion device for the associated watercraft, is journaled.

As is typical with outboard motor practice, the engine 106 is supported in the power head 104 so that its crankshaft 116 (see Section B of FIG. 1) rotates about a vertically extending axis. This is done so as to facilitate connection of the crankshaft 116 to a driveshaft which extends into the lower unit 112 and which drives the propeller 114 through a conventional forward, neutral, reverse transmission contained in the lower unit 112.

The details of the construction of the outboard motor and the components which are not illustrated may be considered to be conventional or of any type known to those wishing to utilize the invention disclosed herein. Those skilled in the art can readily refer to any known constructions of such with which to practice the invention.

With reference now in detail to the construction of the engine 106 still by primary reference to FIG. 1, in the illustrated embodiment, the engine 106 is of the V6 type and operates on a two-stroke, crankcase compression principle. Although the invention is described in conjunction with an engine having this cylinder number and cylinder configuration, it will be readily apparent that the invention can be utilized with engines having other cylinder numbers and other cylinder configurations. Also, although the engine 106 will be described as operating on a two stroke principle, it will also be apparent to those skilled in the art that certain facets of the invention can be employed in conjunction with four-stroke engines. Some features of the invention also can be employed with rotary type engines.

Now, referring primarily to Sections B and D of FIG. 1, the engine 106 comprises a cylinder block 118 that is formed with a pair of cylinder banks 120. Each of these cylinder banks 120 comprises three vertically spaced, horizontally extending cylinder bores 122. The cylinders bores 122 are numbered #1–6 from top to bottom and will be referred to individually as cylinder 1 etc. Pistons 124 reciprocate in these cylinder bores 122. The pistons 124 are, in turn, connected to the upper or small ends of connecting rods 126. The big ends of these connecting rods are journaled on the throws of the crankshaft 116 in a manner that is well known in this art.

The crankshaft 116 is journaled in a suitable manner for rotation within a crankcase chamber 128 that is formed in part by a crankcase member 130. The crankcase member 130 is affixed to the cylinder block 118 in a suitable manner. As is typical with two-cycle engines, the crankshaft 116 and crankcase chamber 128 are formed with seals so that each section of the crankcase, which is associated with one of the cylinder bores 122, is sealed from the other sections. This type of construction is well known in the art.

Figure 2:
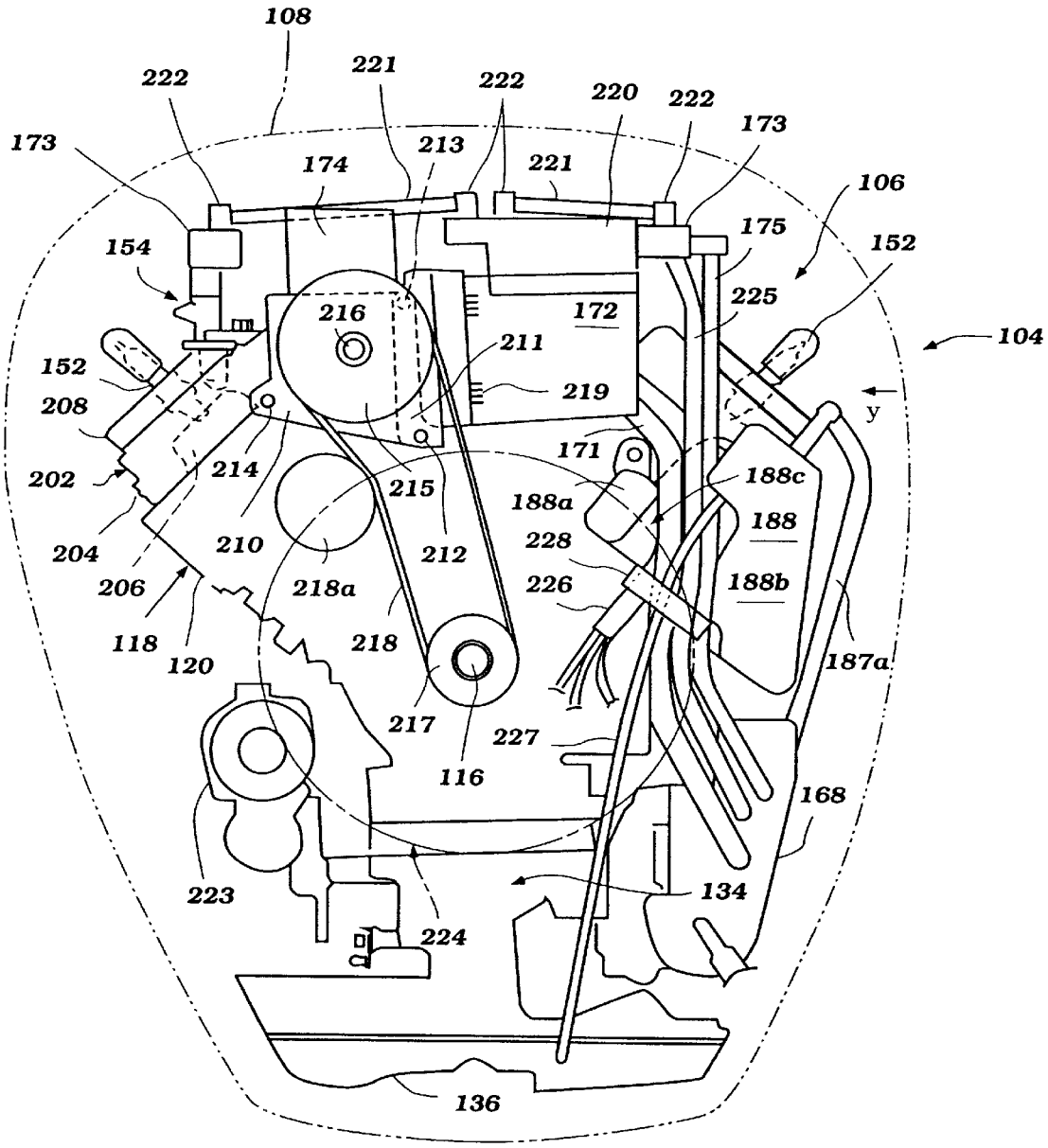
FIG. 2 is a top plan view of a power head of the engine showing the engine in solid lines and the cowling in phantom lines.

With reference to FIG. 2, a cylinder head assembly, indicated generally by the reference numeral 202, is affixed to an end of each cylinder bank 120 that is spaced from the crankcase chamber 128. These cylinder head assemblies 202 comprise a main cylinder head member 204 that defines a plurality of recesses 206 in its lower face. Each of these recesses 206 cooperate with a respective cylinder bore 122 and the head of the piston 124 to define the combustion chambers of the engine, as is well known in the art. A cylinder head cover member 208 completes the cylinder head assembly 202. The cylinder head members 204, 208 are affixed to each other and to the respective cylinder banks 120 in a suitable, known manner.

With reference again primarily to FIG. 1, Sections B and C, an air induction system, indicated generally by the reference numeral 132 is provided for delivering an air charge to the sections of the crankcase chamber 128 associated with each of the cylinder bores 122. This communication is via an intake port 134 formed in the crankcase member 130 and registering with each such crankcase chamber section.

The induction system 132 includes an air silencing and inlet device, shown schematically in this figure and indicated by the reference numeral 136. In actual physical location, this device 136 is contained within the cowling 108 at the forward end thereof and has a rearwardly facing air inlet opening 138 through which air is drawn. Air is admitted into the interior of the cowling 108 in a known manner, and this is primarily through a pair of rearwardly positioned air inlets that have a construction that is generally well known in the art.

The air inlet device 136 supplies the induced air to a plurality of throttle bodies 140, each of which has a throttle valve 142 provided therein. These throttle valves 142 are supported on throttle valve shafts. These throttle valve shafts are linked to each other for simultaneous opening and closing of the throttle valves 142 in a manner that is well known in this art.

As is also typical in two-cycle engine practice, the intake ports 134 have, provided in them, reed-type check valves 144. These check valves 144 permit the air to flow into the sections of the crankcase chamber 128 when the pistons 124 are moving upwardly in their respective cylinder bores. However, as the pistons 124 move downwardly, the charge will be compressed in the sections of the crankcase chamber 128. At that time, the reed type check valve 144 will close so as to permit the charge to be compressed.

In accordance with a preferred embodiment of the present invention, an oil pump 146 pumps oil to a solenoid valve unit 150. In the preferred embodiment, the oil pump 146 is driven by the crankshaft 116; however, an electric oil pump can be used in the alternative. The solenoid valve unit 150 regulates the delivery of oil to the throttle body 140 of each cylinder 122. The oil passes through the throttle body 140 and into the crankcase chamber 128 to lubricate the components of each cylinder 122. An ECU (Electronic Control Unit) 148 sends control signals through a number of drive signal lines 149 to the solenoid valve unit 150 to regulate the timing of oil delivery to each cylinder 122. The oil delivery system will be described in greater detail below.

The charge which is compressed in the sections of the crankcase chamber 128 is then transferred to the combustion chamber through a scavenging system (not shown) in a manner that is well known. A spark plug 152 is mounted in the cylinder head assembly 202 for each cylinder bore. The spark plug 152 is fired under the control of the ECU 148. The ECU 148 receives certain signals for controlling the time of firing of the spark plugs 152 in accordance with any desired control strategy.

The spark plug 152 ignites a fuel air charge that is formed by mixing fuel directly with the intake air via a fuel injector 154. The fuel injectors 154 are solenoid type injectors and electrically operated.

The ECU 148 controls the timing and the duration of fuel injection. The ECU 148 thus controls the opening and closing of the solenoid valves of the fuel injectors 154, and in particular, controls the selective supply of current to the solenoids of the fuel injectors 154.

With reference to Sections C and D of FIG. 1, fuel is supplied to the fuel injectors 154 by a fuel supply system, indicated generally by the reference numeral 156. The fuel supply system 156 comprises a main fuel supply tank 158 that is provided in the hull 159 of the watercraft with which the outboard motor 100 is associated. Fuel is drawn from this tank 158 through a conduit 160 by a first low pressure pump 162 and a plurality of second low pressure pumps 164. The first low pressure pump 162 is a manually operated pump and the second low pressure pumps 164 are diaphragm type pumps operated by variations in pressure in the sections of the crankcase chamber 128, and thus provide a relatively low pressure. A quick disconnect coupling is provided in the conduit 160 and a fuel filter 166 is positioned in the conduit 160 at an appropriate location.

From the low pressure pump 164, fuel is supplied to a vapor separator 168 which is mounted on the engine 106 or within the cowling 108 at an appropriate location. This fuel is supplied through a line 169, and a float valve regulates fuel flow through the line 169. The float valve is operated by a float that disposed within the vapor separator 168 so as to maintain a generally constant level of fuel in the vapor separator 168.

A high pressure electric fuel pump 170 is provided in the vapor separator 168 and pressurizes fuel that is delivered through a fuel supply line 171 to a high pressure fuel pump, indicated generally by the reference numeral 172. The electric fuel pump 170, which is driven by an electric motor, develops a pressure such as 3 to 10 kg/cm2. A low pressure regulator 170*a* is positioned in the line 171 at the vapor separator 168 and limits the pressure that is delivered to the high pressure fuel pump 172 by dumping the fuel back to the vapor separator 168.

With reference to Section D of FIG. 1, fuel is supplied from the high pressure fuel pump 172 to a pair of vertically extending fuel rails 173 through a flexible pipe 173*a*. The pressure in the high pressure delivery system 172 is regulated by a high pressure regulator 174 which dumps fuel back to the vapor separator 168 through a pressure relief line 175 in which a fuel heat exchanger or cooler 176 is provided.

After the fuel charge has been formed in the combustion chamber by the injection of fuel from the fuel injectors 154, the charge is fired by firing the spark plugs 152. The injection timing and duration, as well as the control for the timing of firing of the spark plugs 152, are controlled by the ECU 148.

Once the charge burns and expands, the pistons 124 will be driven toward the crankcase in the cylinder bores until the pistons 124 reach the lowermost position (i.e., Bottom Dead Center). Through this movement, an exhaust port (not shown) is opened to communicate with an exhaust passage 177 (see the lower left-hand view) formed in the cylinder block 118.

The exhaust gases flow through the exhaust passages 177 to collector sections of respective exhaust manifolds that are formed within the cylinder block 118. These exhaust manifold collector sections communicate with exhaust passages formed in an exhaust guide plate on which the engine 106 is mounted.

A pair of exhaust pipes 178 extend the exhaust passages 177 into an expansion chamber 179 formed in the drive shaft housing 102. From this expansion chamber 179, the exhaust gases are discharged to the atmosphere through a suitable exhaust system. The length of the exhaust pipe 178, from the cylinder 122 to the end of the exhaust pipe 178, differs between some or all of the cylinders 122. As is well known in outboard motor practice, this may include an underwater, high speed exhaust gas discharge and an above the water, low speed exhaust gas discharge. Since these types of systems are well known in the art, a further description of them is not believed to be necessary to permit those skilled in the art to practice the invention.

Any type of desired control strategy can be employed for controlling the time and duration of fuel injection from the injector 154 and timing of firing of the spark plug 152; however, a general discussion of some engine conditions that can be sensed and some other ambient conditions that can be sensed for engine control will follow. It is to be understood, however, that those skilled in the art will readily understand how various control strategies can be employed in conjunction with the components of the invention.

The control for the fuel air ratio preferably includes a feedback control system. Thus, a combustion condition or oxygen sensor 180 is provided and determines the incylinder combustion conditions by sensing the residual amount of oxygen in the combustion products at about a time when the exhaust port is opened. This output signal is carried by a line to the ECU 148, as schematically illustrated in FIG. 1.

As seen in Section B of FIG. 1, a crank angle position sensor 181 measures the crank angle and transmits it to the ECU 148, as schematically indicated. Engine load, as determined by throttle angle of the throttle valve 142, is sensed by a throttle position sensor 182 which outputs a throttle position or load signal to the ECU 148.

There is also provided a pressure sensor 183 communicating with the fuel line connected to the pressure regulator 174. This pressure sensor 183 outputs the high pressure fuel signal to the ECU 148 (signal line is omitted). There also may be provided a trim angle sensor 184 (see the lower right-hand view) which outputs the trim angle of the motor to the ECU 148. Further, an intake air temperature sensor 185 (see the upper view) may be provided and this sensor 185 outputs an intake air temperature signal to the ECU 148. An atmospheric pressure sensor 185*a* measures the atmospheric pressure of the ambient air and transmits a signal representing the pressure to the ECU 148. There may also be provided a back-pressure sensor 186 that outputs exhaust back pressure to the ECU 148.

The sensed conditions are merely some of those conditions which may be sensed for engine control and it is, of course, practicable to provide other sensors such as, for example, but without limitation, an engine height sensor, a knock sensor, a neutral sensor, a watercraft pitch sensor and an atmospheric temperature sensor in accordance with various control strategies.

The ECU 148 computes and processes the detection signals of each sensor based on a control map. The ECU 148 forwards control signals to the fuel injector 154, spark plug 152, the electromagnetic solenoid valve unit 150, and the high pressure electric fuel pump 170 for their respective control. These control signals are carried by respective control lines that are indicated schematically in FIG. 1.

With reference to FIG. 2, a pump drive unit 210 is provided for driving the high pressure fuel pump 172. The high pressure fuel pump 172 is mounted on the pump drive unit 210 with bolts. The high pressure fuel pump 172 can develop a pressure of, for example, 50 to 100 kg/cm2 or more.

The pump drive unit 210 is attached through a stay 211 to the cylinder block 118 with bolts 212, 213. The pump drive unit 210 is further affixed to the cylinder block 118 directly by bolt 214. The pump drive unit 210 thus overhangs between the two banks 120 of the V-cylinder arrangement. A pulley 215 is affixed to a pump drive shaft 216 of the pump drive unit 210. The pulley 215 is driven by a drive pulley 217 affixed to the crankshaft 116 by means of a drive belt 218. The pump drive shaft 216 is provided with a camdisk extending horizontally for pushing plungers which are disposed on the high pressure fuel pump 172.

The driving pulley 217 in the pump drive unit 210 of the high pressure fuel pump 172 is mounted on the crankshaft 116, while the driven pulley 215 is mounted on the pump drive shaft 216 of the pump drive unit 210. The driving pulley 217 drives the driven pulley 215 by means of the drive belt 218. A belt tensioner 218*a* maintains tension in the drive belt 218. The high pressure pump 172 is mounted on either side of the pump drive unit 210 and is driven by the drive unit 210 in a manner described above.

The stay 211 is affixed to the cylinder block 118 with bolts so as to extend from the cylinder block 118 and between both cylinder banks 120. The pump drive unit 210 is then partly affixed to the stay 211 with bolts 212, 213 and partly directly affixed to a boss of the cylinder block 118 so that the pump drive unit 210 is mounted on the cylinder block 118 as overhanging between the two banks 120 of the V arrangement.

The high pressure pump 172 is mounted on the pump drive unit 210 with bolts 219 at both side of the pump drive unit 210. In this regard, a diameter of the bolt receiving openings on the pump drive unit 210 is slightly larger than a diameter of the bolts 219. Thus, the mounting condition of the high pressure pump 172 on the pump drive unit 210 is adjustable within a gap made between the opening and the bolt 219. The respective high pressure pump 172 has a unified fuel inlet and outlet module 220 which is mounted on a side wall of the pressure pump 172. A flexible pipe 221 delivers fuel from the unified fuel inlet and outlet module 220 to the fuel rails 173. The flexible pipe is connected at each end by connectors 222.

In order to start the motor 100, a starter motor 223 engages with and rotates a flywheel 224 that is connected to the crankshaft 116.

The key components of the oil injection system of the present invention will now be described, first with reference to FIG. 1. As best viewed in Section C of FIG. 1, an oil sub tank 187 located in the hull of the watercraft serves as a reservoir of lubrication oil for the engine 106. A suitable delivery pump supplies oil from the oil sub tank 187 through an oil supply pipe 187*a* to a main oil tank 188 mounted to the side of the cylinder block 118. The delivery pump can, for example, be located within the oil sub tank 187 or can be positioned within the supply pipe 187*a*, and can be either electrically or mechanically driven. An oil feed pipe 189 supplies oil from the bottom of the main oil tank 188 to the oil pump 146. The oil pump 146 in turn supplies oil to the solenoid valve unit 150, which regulates the flow of oil to the cylinders 122. The solenoid valve unit 150 is preferably controlled via control signals from the ECU 148. As best viewed in Section A of FIG. 1, an oil level sensor 191 relays the level of oil in the main oil tank 188 to the ECU 148.

In the preferred embodiment, the solenoid valve unit 150 also regulates the flow of oil to the vapor separator tank 168 through an oil supply pipe 190 for mixture with fuel. The addition of a small amount of oil to the fuel of a fuel injected engine has been found to inhibit the formation of deposits on fuel injectors and to extend their useful life. The addition of oil may also help prevent corrosion when water is present in the system. The oil delivered directly to the combustion chamber with the fuel charge may also help to lubricate the components of the fuel system.

The main oil tank 188 is mounted to one side of the cylinder block 118. The main oil tank 188 has elevated portions 188*a*, 188*b* that are separated by a recess 188*c* in the tank 188. The elevated portions 188*a*, 188*b* are designed to provide increased volume in the tank. The inner elevated portion 188*a* is designed to fit below the flywheel 224. The outer elevated portion 188*b* is located adjacent the flywheel 224 and extends above the level of the flywheel 224. The recess 188*c* is configured to allow a number of pipes, conduits, and wires to pass over the recess 188*c* of the tank but under the flywheel 224. These pipes, conduits, and wires comprise an overflow pipe 225, the pressure relief line 175, the fuel supply line 171, a portion of a wiring harness 226, and an oil mist outlet hose 227. The oil mist outlet hose 227 directs oil vapor from the main oil tank 188 to the air inlet device 136. A bracket 228 holds the pipes, conduits and wires in place in the recess 188*c*.

Figure 3:
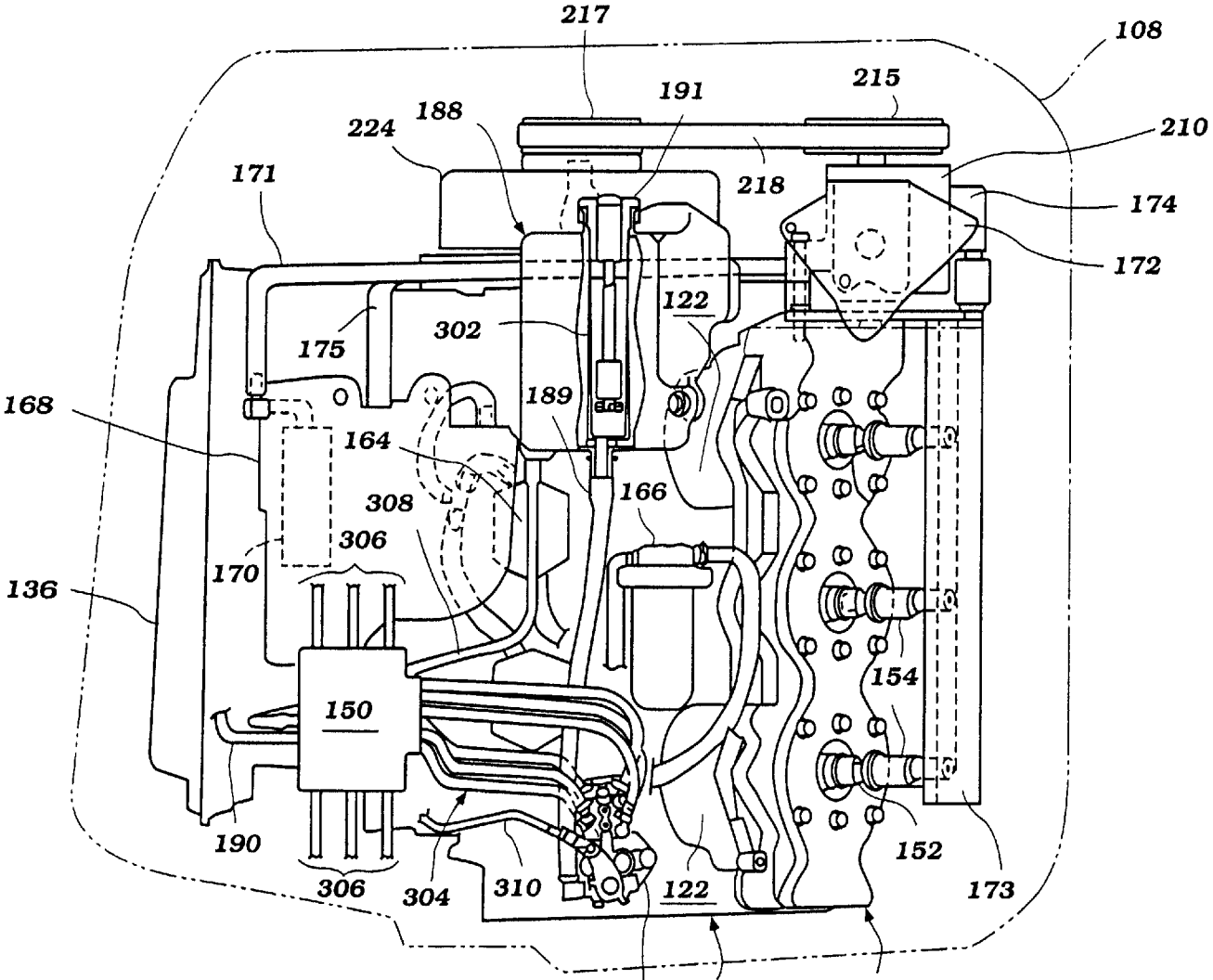
FIG. 3 is a side elevational view of the engine as viewed in the direction of arrow Y of FIG. 2 and illustrates a number of components of the oil injection system.

As seen in FIG. 3, a filter 302 filters lubricating oil before it passes through an outlet on the bottom of the main oil tank 188 and into the oil feed pipe 189. The oil feed pipe 189 delivers the oil to the oil pump 146. The oil pump 146 supplies oil through a number of oil delivery pipes 304 to the solenoid valve unit 150. The number of oil delivery pipes 304 preferably corresponds to the number of cylinders 122 in the engine 106. Alternatively, fewer oil delivery pipes 304 (e.g., one) can be used with an inlet manifold that feed the individual parts of the valve unit 150. A number of oil supply pipes 306 supply oil from the solenoid valve unit 150 to each cylinder 122 through the air induction system 132. The number of oil supply pipes 306 preferably corresponds to the number of cylinders 122 in the engine 106. The oil supply pipes 306 are preferably configured so that their lengths are as short as possible to minimize the distance the oil must travel to the air induction system 132 for each cylinder 122. The solenoid valve unit 150 also delivers an amount of oil to the vapor separator tank 168 through the oil supply pipe 190 preferably for mixture with fuel. Any unused oil not delivered to the cylinders 122 or the vapor separator tank 168 is returned to the main oil tank 188 via an oil return pipe 308.

In the preferred embodiment, the oil pump 146 is a positive displacement type oil pump that is driven by the crankshaft 116. A positive displacement type oil pump delivers a volume of oil for each crankshaft revolution as opposed to, for example, an impeller type pump that supplies an approximate pressure of oil based upon engine speed. The oil pump 146 preferably also has an adjustment lever 310 that is configured to adjust the discharge rate per crankshaft revolution of the oil pump 146. The adjustment lever 310 is preferably interconnected with the throttle to vary the discharge rate in relation to the throttle level. The oil pump 146 may also be further configured to vary the volume of oil delivered based upon engine speed. Alternatively, the pump 146 may be configured to vary the volume of oil delivered based upon a control signal from the ECU 148. For example, the ECU 148 could control an actuation mechanism (not illustrated) that actuates the adjustment lever 310. The control signal sent by the ECU 148 may be based upon a control map that takes into account engine operation factors such as engine speed, throttle position, and engine load.

In the preferred embodiment, the adjustment lever 310 allows the oil pump 146 to deliver slightly more than the required amount of oil. The oil delivery is then fine tuned appropriately for each cylinder by the ECU 148 through the solenoid valve unit 150. Typical positive displacement pumps deliver a constant volume of oil per crankshaft revolution, regardless of engine speed or throttle position. The oil required per crankshaft revolution, however, is typically lower at slower engine speeds (i.e., at lesser open throttle positions) and higher at higher engine speeds (i.e., at more open throttle positions). Accordingly, the oil delivery rate of a typical positive displacement type pump would have to be reduced by a greater proportion at lower engine speeds in order to supply the appropriate amount of oil. The adjustment lever 310 of the preferred embodiment, however, allows the oil pump 146 to deliver proportionally more oil per revolution as the throttle position is opened. Increased engine speeds are associated with increased throttle positions, and in this manner the amount of oil to be delivered per revolution can be increased in relation to engine speed. The adjustment lever 310, by allowing the oil pump to supply reduced amount of oil per revolution at lower engine speeds, allows the solenoid valve unit 150 to appropriately regulate, through fine tuning, an oil supply that is already approximate the correct amount.

Figure 4:
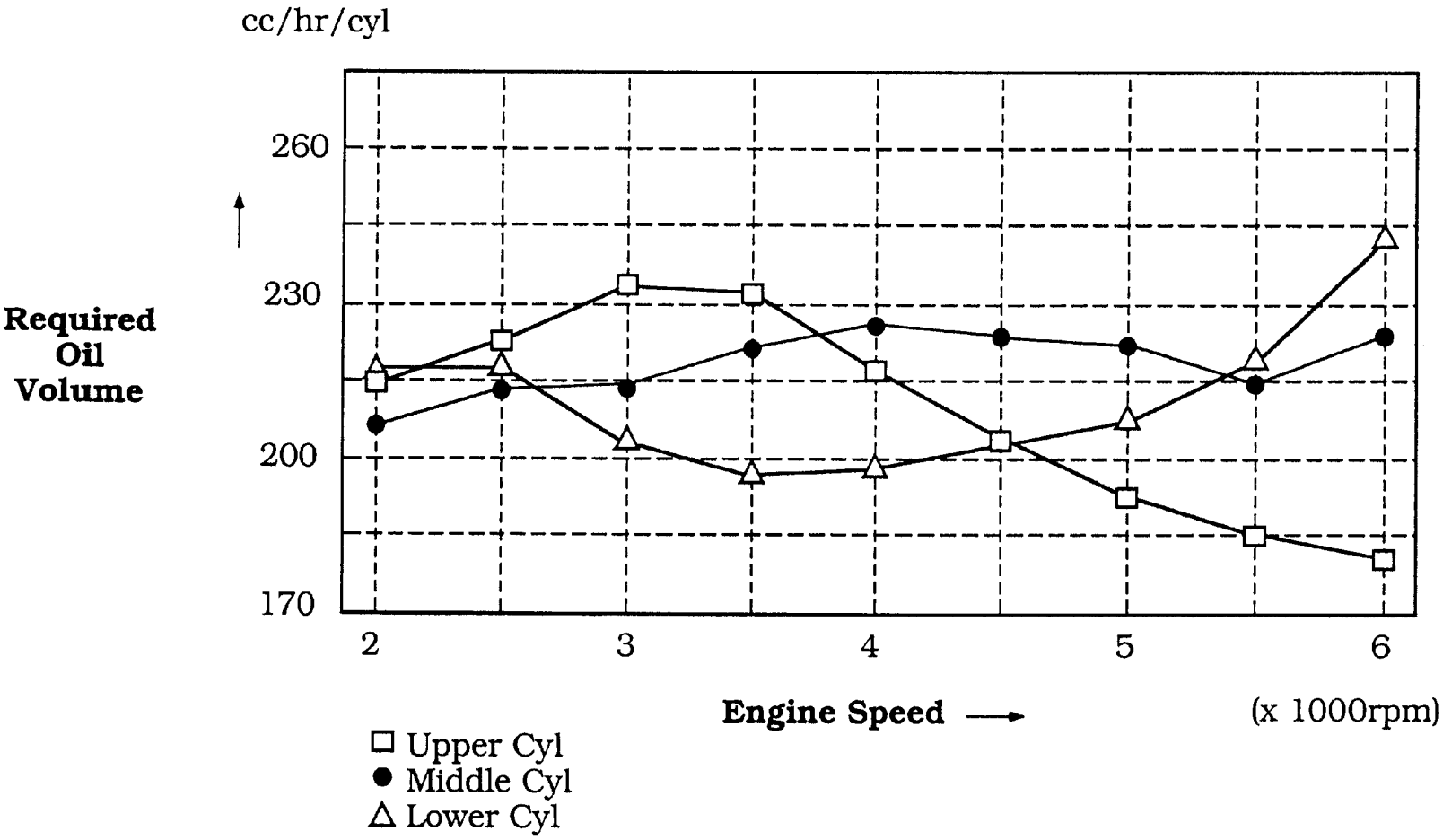
FIG. 4 is a graph of the relationship between engine speed and desired or required oil supply volumes for various cylinders of the disclosed engine in accordance with a preferred embodiment of the invention.

FIG. 4 is a graph of the relationship between engine speed and desired or required oil supply volume for various cylinders of the disclosed engine in an exemplary embodiment. The plot with square points indicates the required oil supply to the upper cylinders 1 and 2. The plot with circular points indicates the required oil supply to the middle cylinders 3 and 4. The plot with triangular points indicates the required oil supply to the lower cylinders 5 and 6. At lower engine speeds, the required oil volume for each cylinder is substantially the same. At intermediate speeds, the upper cylinders require more oil than the lower oil cylinders. At higher engine speeds, the lower cylinders require more oil than the upper cylinders.

In two-cycle engines in general, a first cylinder may intake more air per combustion cycle than a second at any single engine speed. As engine speed varies, the second cylinder, alternatively, may intake more air per combustion cycle than the first. These variations in volumetric flow through each cylinder are a result of different tuning frequencies for the exhaust passages of different cylinders. The variations in volumetric flow, in turn, cause differences in cylinder loading and accordingly different combustion chamber temperatures. As a consequence, at any engine speed, the amounts of oil required may differ between the cylinders.

Other factors also affect the amount of oil needed by each cylinder. The temperature at the bottom cylinders is typically cooler than the temperature at the top cylinders. This factor decreases the amount of oil required by the bottom cylinders in relation to the top. Gravity also causes a small amount of oil to drain from the top cylinders to the bottom ones, which also decreases the amount of oil required by the bottom cylinders. Accordingly, the amount of oil supplied to each cylinder is preferably determined by taking these factors into account.

In the preferred embodiment, the oil pump 146 supplies slightly more than a maximum required amount of oil for any cylinder under a given operating condition. For example, with reference to FIG. 4, the oil pump 146 supplies slightly more than 230 cc/hr to each cylinder when running at 3000 rpm. The ECU 148 then uses a control map to fine tune, through the solenoid valve unit 150, the amount of oil actually delivered to each cylinder 122.

Figure 5:
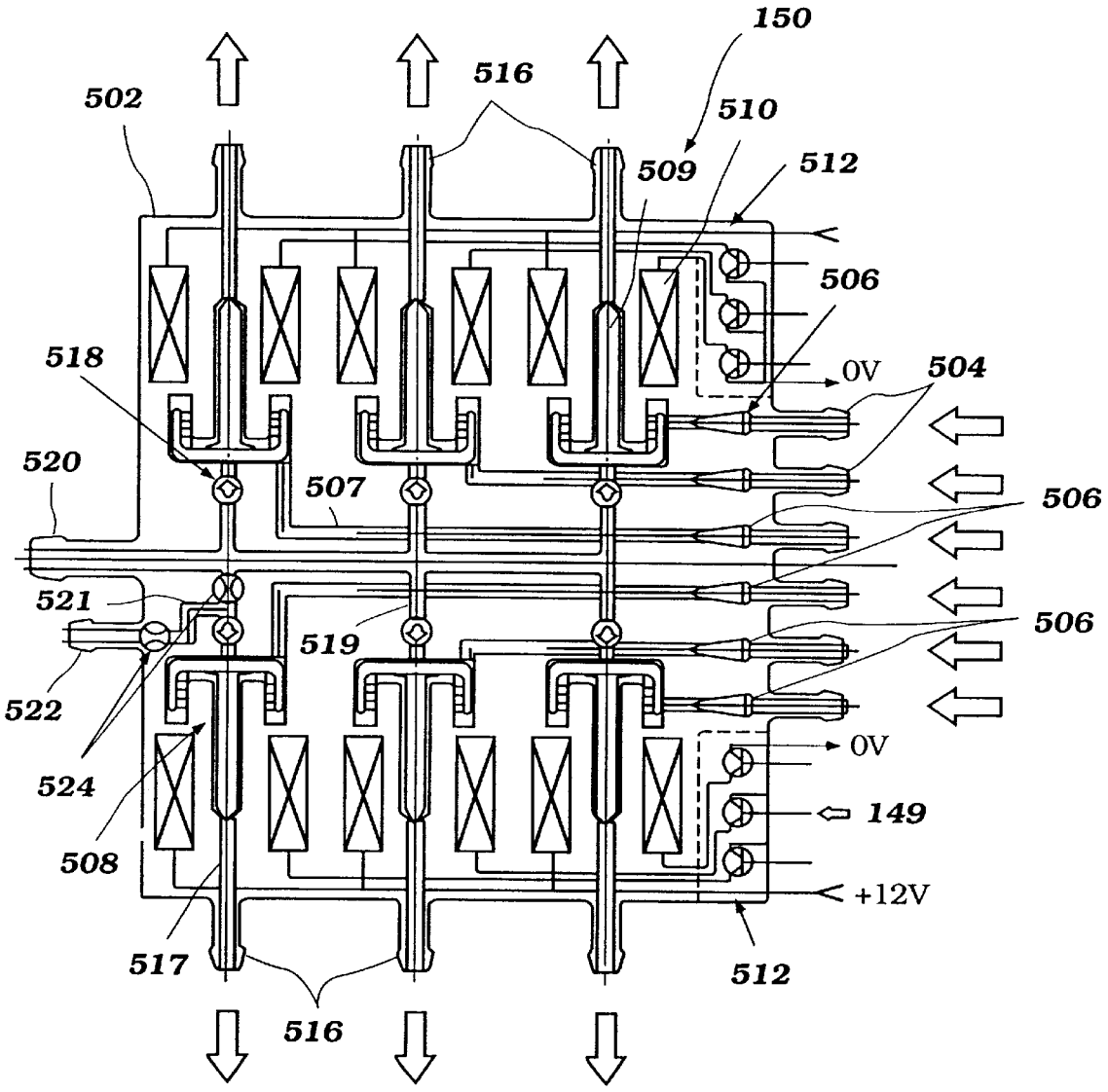
FIG. 5 illustrates an enlarged cross-sectional view of a solenoid valve unit of the engine control system.

FIG. 5 illustrates a cross section view of a preferred embodiment of the solenoid valve unit 150 viewed from the same perspective as FIG. 3. In the preferred embodiment, the solenoid valve unit 150, as driven by the ECU 148, appropriately fine tunes for each cylinder based upon engine conditions, an approximately correct amount of oil supplied by the oil pump 146. The body 502 of the valve unit 150 houses a number of oil passages and valves for regulating the flow of oil to the cylinders 122 and to the vapor separator tank 168. A number of oil inlet ports 504 located on the exterior of the body 502 are connected to the oil delivery pipes 304. The oil delivery pipes 304 deliver oil from the oil pump 146 to the solenoid valve unit 150. Oil passes through the oil inlet ports 504 and through a filter 506 associated with each oil inlet port 504. From each filter 506, oil flows through an inlet passage 507 within the body 502 to one of a number of solenoid valves indicated generally by the number 508. Each solenoid valve 508 comprises a control valve 509, which is actuated through a magnetic field generated by a coil 510. The current in each coil 510 is regulated by a driving circuit 512 preferably containing a switching transistor. The switching transistors of the driving circuits 512 are in turn connected to the drive signal lines 149 that carry control signals from the ECU 148. In this manner, the ECU 148 can control the actuation of each solenoid valve 508.

In the preferred embodiment, each solenoid valve 508 is configured to switch the passage of oil to either a supply port 516 or an oil return port 520. When the solenoid is off, or in other words when the coil 510 is not carrying a current, the solenoid valve 508 is "open" and allows oil to pass through a supply passage 517 to its associated supply port 516. The supply ports 516 are connected to the oil supply pipes 306 in order to supply oil to the cylinders 122. When the solenoid is on or carrying a current, the solenoid valve 508 is "closed" and directs the passage of oil through a return passage 519 to a junction with a common oil return port 520. A check valve 518 is installed in-line in the return passage 519 between the solenoid valve 508 and the junction with the common oil return port 520 to prevent backflow of oil through the passage 519. The oil return port 520 is connected to the oil return pipe 308 to return excess oil to the main oil tank 188.

An additional supply passage 521 branches off from of one of the return passages 519 to supply an amount of oil to an additional oil supply port 522. The additional oil supply port 522 is connected to the oil supply pipe 190, which delivers the oil to the vapor separator tank 168 for mixture with fuel. Two adjustment orifices 524 are provided to regulate the proportion of oil that is directed to the oil supply port 522 as opposed to the common oil return port 520. One adjustment orifice 524 is positioned in the additional supply passage 521. The other adjustment orifice 524 is positioned in the corresponding return passage 519 between the branch and the junction with the common oil return port 520. The adjustment orifices 524 can be selected so that an appropriate amount of oil is delivered to the fuel injection system to inhibit deposit buildup on the fuel injectors, rust, and/or corrosion. In another variation, the additional supply passage 521 can be configured to branch off after the junction between the return passages 519 and the common oil return port 520.

The driving circuits 512, solenoid valves 508, ECU 148, and control lines 149 are preferably configured such that an active control signal from the ECU 148 and an active power supply to the solenoid valve unit 150 are required to redirect the oil flow away from the supply ports 516 that supply lubricant to the cylinders 122. This configuration serves as a safety feature in that if one or more of the signals from the ECU 148 are prevented from reaching the solenoid valve unit 148, oil is still supplied to the cylinders 122. Furthermore, if power to the solenoid valve unit 148 is disrupted, oil will also still be supplied to the cylinders 122.

In the preferred embodiment, the solenoid valve unit 150 draws power through the solenoid coils 510 whenever oil is not supplied to the cylinders 122. At very low engine speeds, less oil needs to be delivered to the cylinders 122. Instead of limiting oil supply through the solenoid valve unit 150, which draws power, oil flow is limited through the flow adjustment lever 310 of the oil pump 146 by linking it to the throttle. The oil pump 146 is preferably mechanically controlled to deliver slightly more than the required volume of oil at each engine speed. Accordingly, the solenoid valves 508 need be used less frequently to limit the flow of oil resulting in a lower electrical power consumption.

Figure 6:
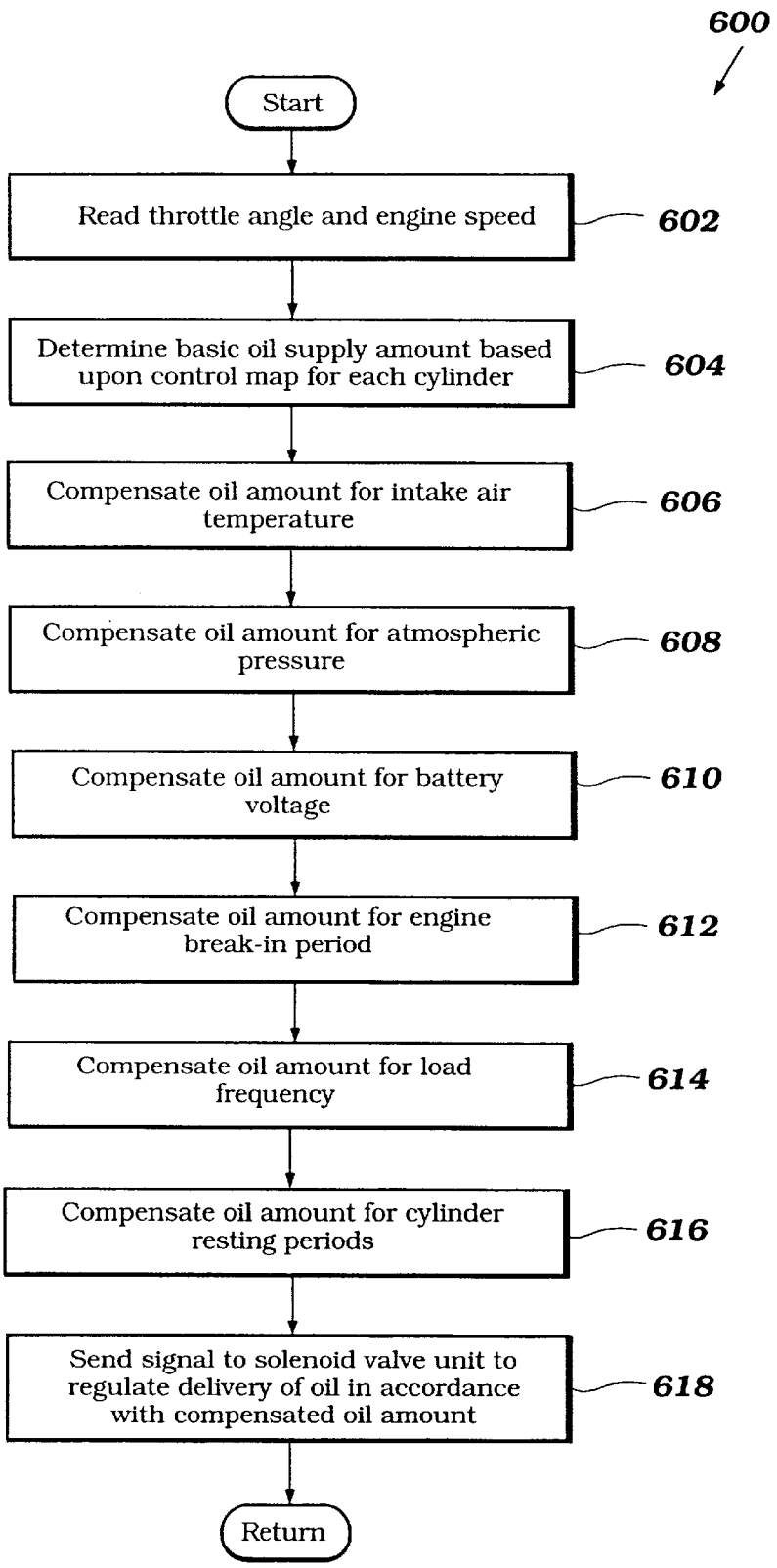
FIG. 6 illustrates a flowchart of a preferred process in accordance with which the ECU regulates or fine tunes the amount of oil delivered to each cylinder.
Figure 7A:
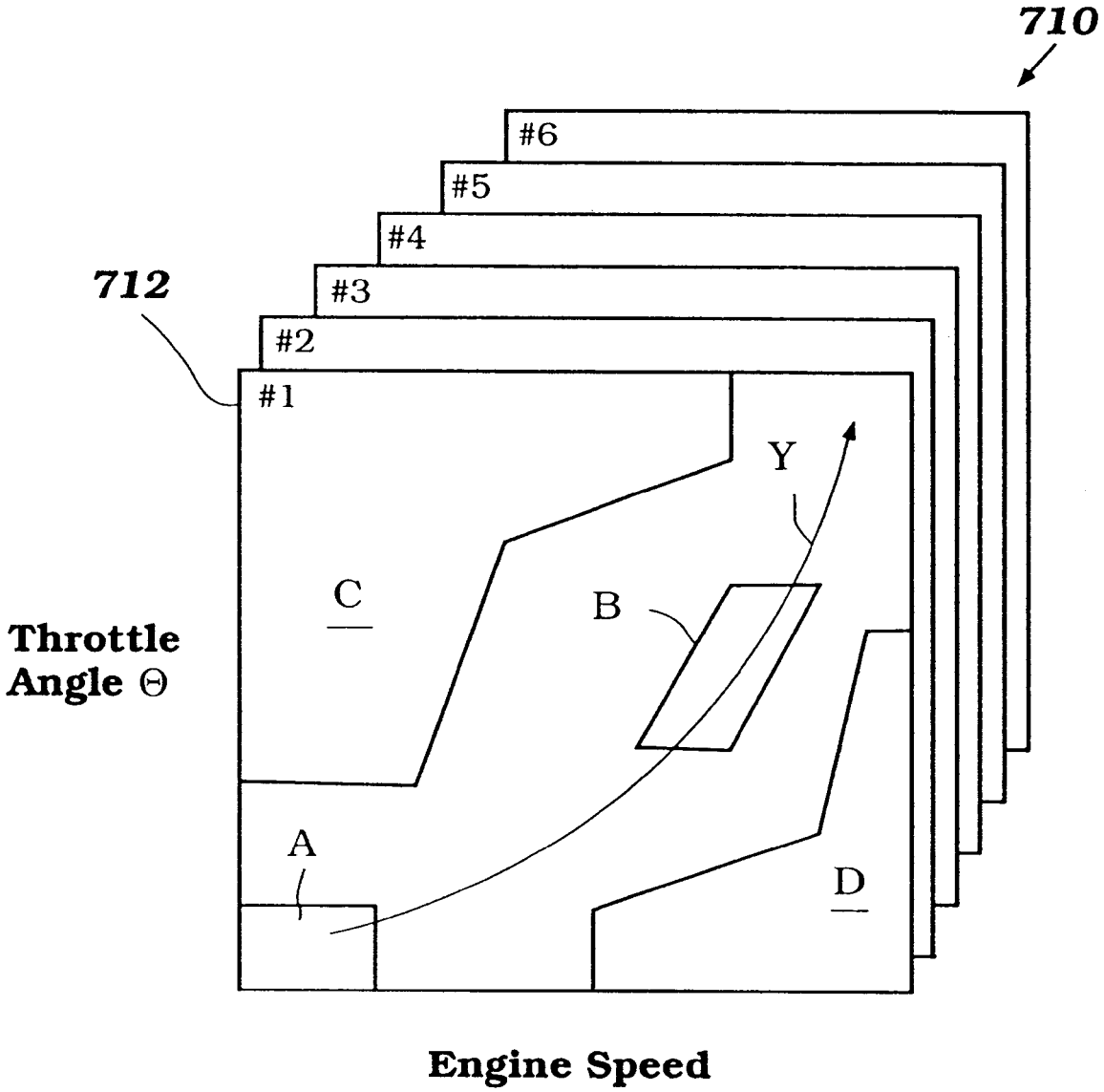
FIGS. 7A–C illustrate example control maps in accordance with which the ECU can determine the basic oil supply amount for each cylinder.
Figure 7B:
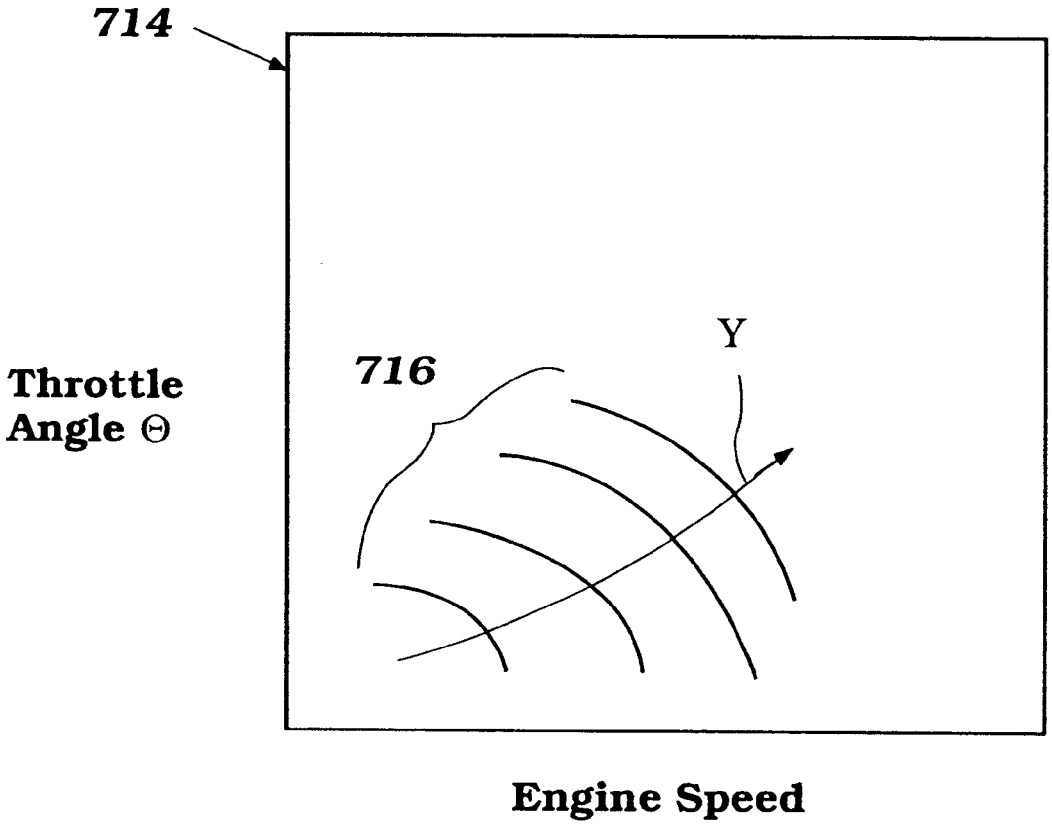
Figure 7C:
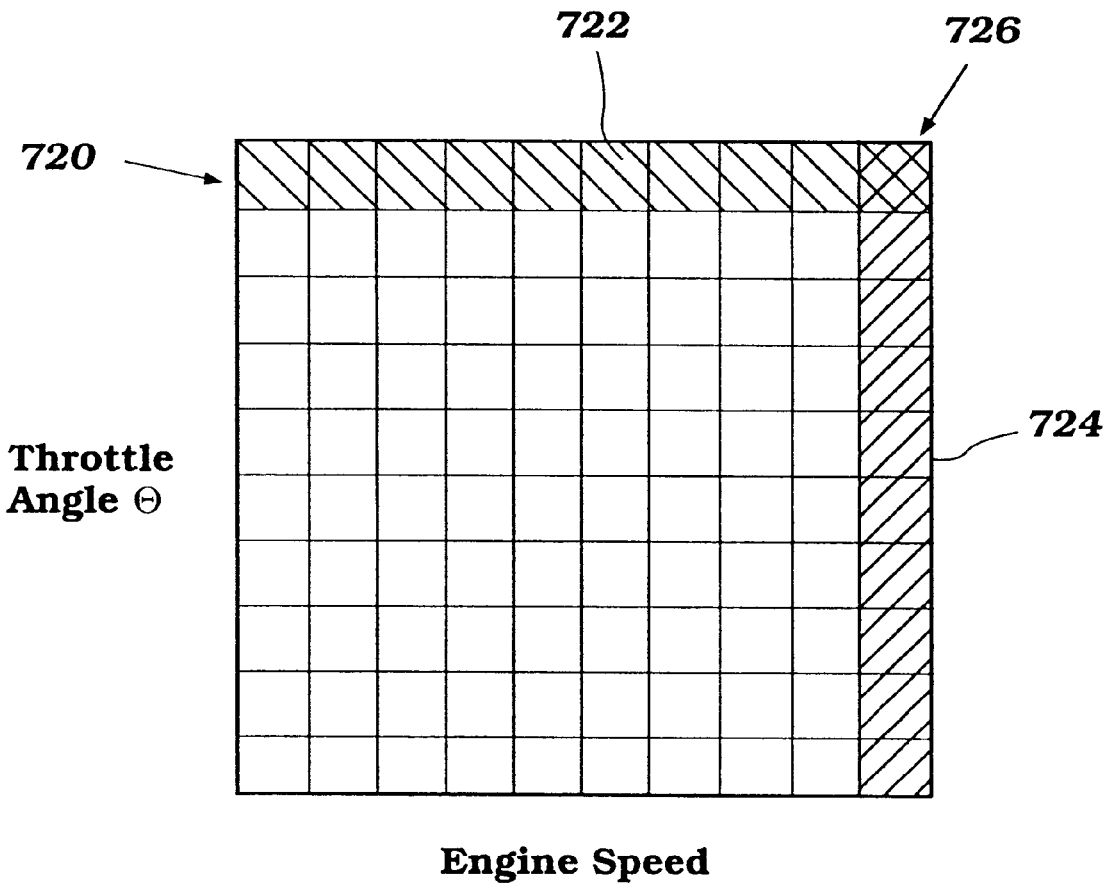

FIG. 6 illustrates a flowchart 600 of a preferred process in accordance with which the ECU 148 regulates or fine tunes the amount of oil delivered to each cylinder 122. At a first step 602, the ECU 148 reads the throttle angle and engine speed. At a step 604, the ECU 148 determines a basic oil supply amount based upon a control map for each cylinder. A number of exemplary control maps are illustrated in FIGS. 7A–C. At a step 606, the ECU 148 compensates the oil amount for the intake air temperature. At a step 608, the ECU 148 compensates the oil amount for atmospheric pressure. At a step 610, the ECU 148 compensates the oil amount for battery voltage. At a step 612, the ECU 148 compensates the oil amount for an engine "break-in" period. At a step 614, the ECU 148 compensates the oil amount for an engine load frequency. At a step 616, the ECU 148 compensates the oil amount for cylinder resting periods. At last step 618, the ECU 148 sends a signal to the solenoid valve unit to regulate the delivery of oil in accordance with the compensated oil amount determined in steps 604–616. A number of the steps in the flowchart 600 will now be described in further detail.

An oil supply amount or oil amount, as used herein, need not be an actual volume or quantity of oil. In a first embodiment, the oil supply amount or oil amount (AMT) is a coefficient that specifies the proportion of the quantity of oil supplied by the oil pump 146 that is actually directed to the cylinders 122 by the solenoid valve unit 150. For example, an AMT of 1.0 may indicate that the full volume of oil delivered by the oil pump 146 is to be directed to the cylinders 122 by the solenoid valve unit 150. On the other hand, an AMT of 0.5 may indicate that only half of the volume of oil delivered by the oil pump 146 is to be directed to the cylinders 122 by the solenoid valve unit 150, while the other half is redirected back to the main oil tank 188. In accordance with this embodiment, control maps specify the basic proportion of oil, AMT, delivered by the oil pump 146 that is actually directed to the cylinders 122. In step 618, the ECU 148 preferably activates the solenoid valves 508 based upon this proportion as compensated in steps 606–616.

FIGS. 7A–C illustrate example control maps in accordance with which the ECU 148 can determine the basic oil supply amount for each cylinder at the step 604. FIG. 7A illustrates six control maps 710, one map for each cylinder 122 of a six cylinder engine. Each control map is preferably a three dimensional map that specifies an oil amount, AMT, (preferably a coefficient of proportion) as a function of throttle angle θ and engine speed, S:

$$AMT=f(\theta, S).$$

A first example control map 712 shows two dimensions, throttle angle θ and engine speed, S and a standard load curve "Y" in the two dimensions. At each point on the two dimensional illustration, the AMT function has a value. The load curve "Y" passes through an idle region "A" in which the control map 712 specifies AMT values which, in conjunction with the variable volume of oil supplied by the oil pump 146, result in a substantially reduced amount of oil being delivered to the cylinders 122. The load curve "Y" also passes through a region "B, " a normal operational region in which the control map 712 specifies AMT values, which, in conjunction with the variable volume of oil supplied by the oil pump 146, result in a slightly less than a standard amount of oil being delivered to the cylinders 122. In a rapid acceleration region "C" and a rapid deceleration region "D" the control map 712 specifies AMT values that result in greater than the standard oil supply amount being delivered to the cylinders 122.

FIG. 7B illustrates a second example control map 714, in accordance with a second embodiment of the invention. In this embodiment, the oil supply amount, AMT, is proportional to the absolute quantity of oil supplied to the cylinders rather than a proportion of the oil delivered by the oil pump 146. In step 618 in this case, the ECU 148 preferably determines the compensated amount of oil to be supplied to the cylinders in steps 604–616. The ECU 148 then subtracts this compensated amount from the amount delivered by the oil pump 146 in order to determine for how long to actuate the solenoid valves 508 (i.e., to determine the actuation duration for each solenoid valve 508 as a proportion of the duty cycle).

FIg. 7B, like FIG. 7A, shows the load curve "Y, " which passes through several equivalent value lines 716. In accordance with this second embodiment, the value of the AMT function remains constant along any one of the equivalent value lines 716. As the load curve "Y" passes up and to the right, the value of the AMT function at each successive equivalent value line is preferably greater to provide increased oil delivery at higher engine speeds and throttle positions. The equivalent value lines 716 serve to illustrate the topographical layout of the three dimensional function AMT in two dimensions.

FIG. 7C illustrates a discretized control map 720 in accordance with either of the above embodiments, wherein each of the throttle angle θ and engine speed, S are discretized to one of a number of possible values. The complete set of combinations of the discretized values of θ and S create an array of possible values for AMT. Each box in the control map 720 represents the value of the AMT function for a particular combination of discrete values for (θ, S). The top line and the far right row are used in the case of sensor failures. If the throttle position sensor 182 fails, the ECU 148 sets the throttle position at its maximum value for the purposes of the control map 720. In this case, the map 720 specifies AMT based only upon engine speed as illustrated by the top row of values 722. If the crank angle position sensor 181 fails, the ECU can no longer determine engine speed and therefore sets the engine speed at its maximum value for the purposes of the control map 720. In this case, the map 720 specifies AMT based only upon throttle position as illustrated by the far right row of values 724. If both sensors 182 and 181 fail, the ECU uses the upper right hand AMT value 726 from the control map 720. In the case the ECU 148 fails altogether, there is no danger since no control signals are sent to the solenoid valve unit 150 and the full amount of oil supplied by the oil pump 146 will reach the cylinders 122.

With reference again to FIG. 6, in the steps 606 and 608 of flowchart 600, the ECU 148 compensates the oil amount, AMT, supplied in step 604, for intake air temperature and atmospheric pressure by multiplying the oil amount by coefficients as follows:

$$AMT=AMT*Ct*Cp$$

Ct: Intake Temperature Compensation Coefficient, Ct=f (Induction Air Temperature), Cp: Atmospheric Pressure Compensation Coefficient, Cp=f(Atmospheric Pressure).

Intake air volume and quantity vary depending on air density. Air density, in turn, depends on temperature and pressure. Accordingly, the ECU 148 preferably uses the induction air temperature and atmospheric pressure to increase the oil supply amount in proportion to air density.

At the step 610 of the flowchart 600, the ECU 148 preferably compensates the oil amount for battery voltage. In accordance with a preferred embodiment of the present invention, the solenoid valves 508 draw electrical power when redirecting oil flow away from the cylinders 122. In order to conserve electrical power under conditions of low battery voltage, the ECU 148 can purposely increase the oil delivery amount. Increasing the oil delivery requires less use of the solenoid valves 508 to redirect the oil flow, and accordingly less power is drawn by the solenoid valves 508 from the battery. The ECU 148 preferably compensates the oil amount supplied in step 608, for battery voltage by multiplying the oil amount by a coefficient as follows:

$$AMT=AMT*Cv$$

Cv: Battery Voltage Compensation Coefficient, Cv=f (Battery Voltage).

Figure 8:
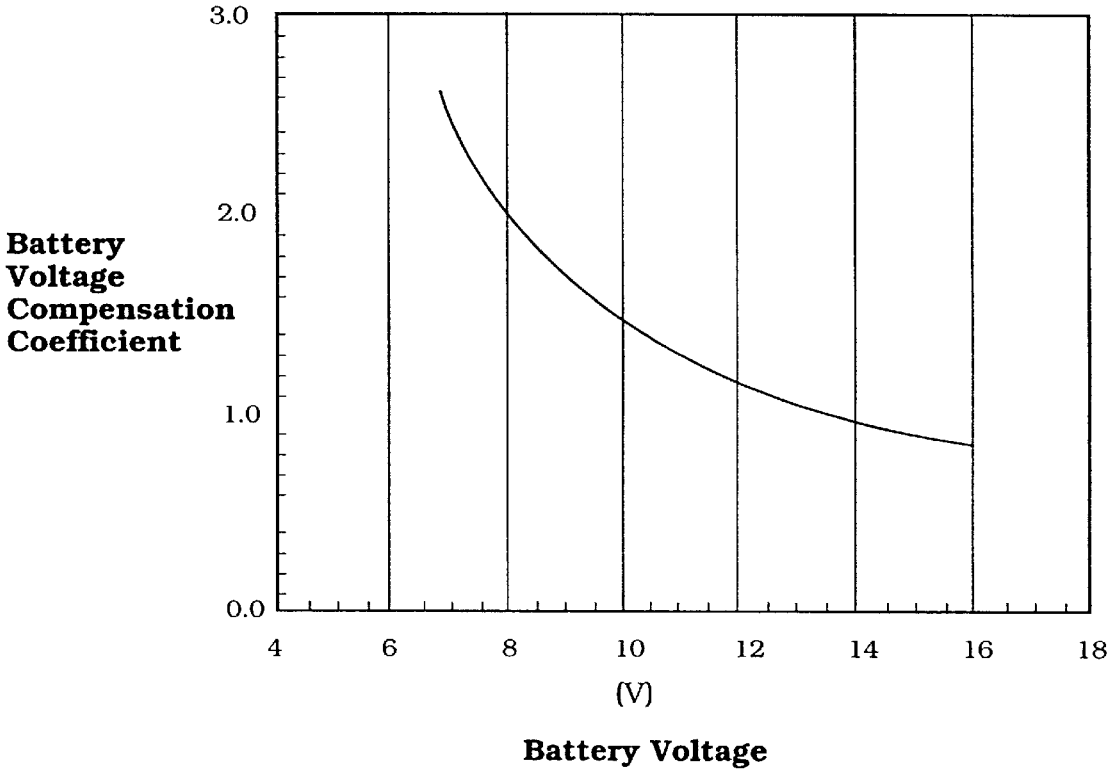
FIG. 8 illustrates a graph of an example battery voltage compensation coefficient as a function of battery voltage.

FIG. 8 illustrates a graph of an example Battery Voltage Compensation Coefficient (vertical axis) as a function of battery voltage (horizontal axis). In accordance with the example graph, the oil supply amount is adjusted in inverse proportion to battery voltage. Other relationships that increase oil supply amount as battery voltage decreases could be used in the alternative. As the battery voltage decreases, the Battery Voltage Compensation Coefficient may eventually increase the oil amount such that it is greater than the amount supplied by the oil pump 146. In this case, the solenoid valves 508 are no longer driven by the ECU 148, drawing no power from the battery, and the full amount of oil supplied by the oil pump 146 reaches the cylinders 122.

At the step 612 of flowchart 600, the ECU 148 compensates the oil amount, AMT, supplied in step 610, for an engine break-in period by multiplying the oil amount by a coefficient as follows:

$$AMT=AMT*Cb$$

Cb: Break-in Elapsed Time Coefficient, Cb=f(t).

Figure 9:
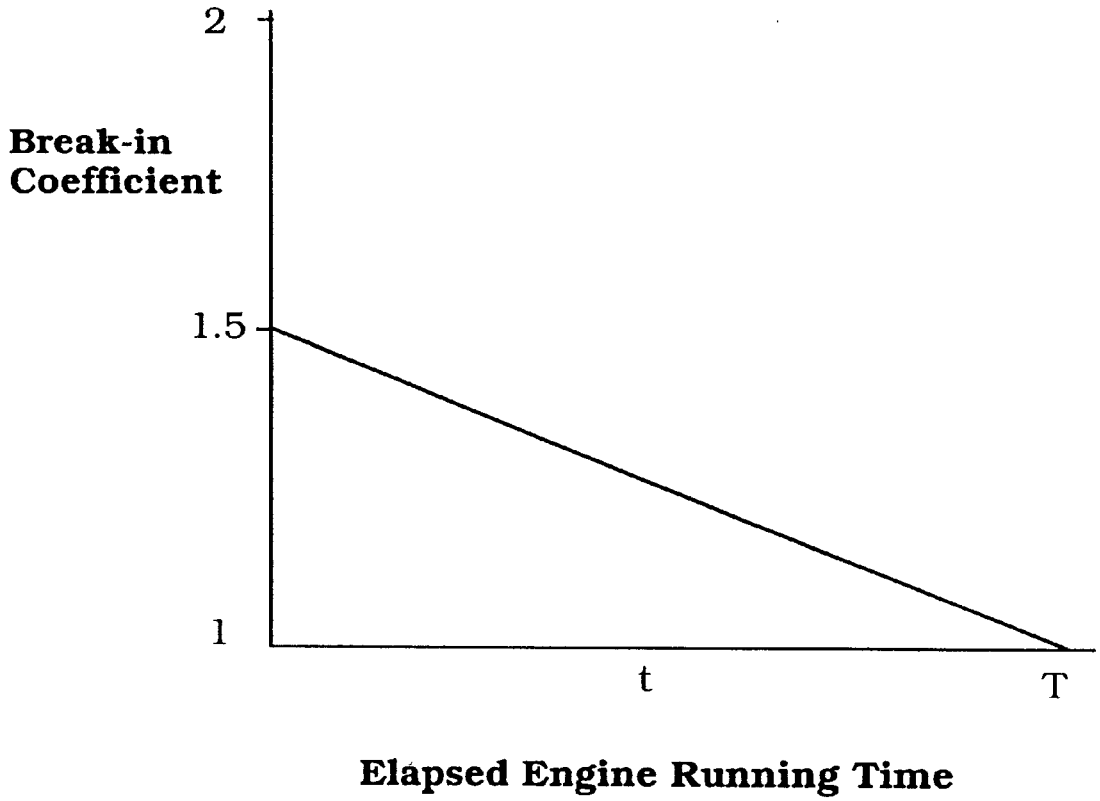
FIG. 9 illustrates a graph of an example break-in elapsed time coefficient function.

FIG. 9 illustrates a graph of an example Break-in Elapsed Time Coefficient function. A new engine with no elapsed running time has a break-in coefficient of 1.5, which decreases at a constant rate until a time T is reached. After time T, the break-in coefficient preferably has a value of 1.

At the step 614 of flowchart 600, the ECU 148 compensates the oil amount, AMT, supplied in step 612 for a Load Frequency Coefficient, C1. The load frequency coefficient is based upon the proportion of an engine's running time during which it is operated at various load levels. The ECU 148 preferably uses throttle position as a determinant of engine load; however, other techniques for determining engine load may be used.

Figure 10:
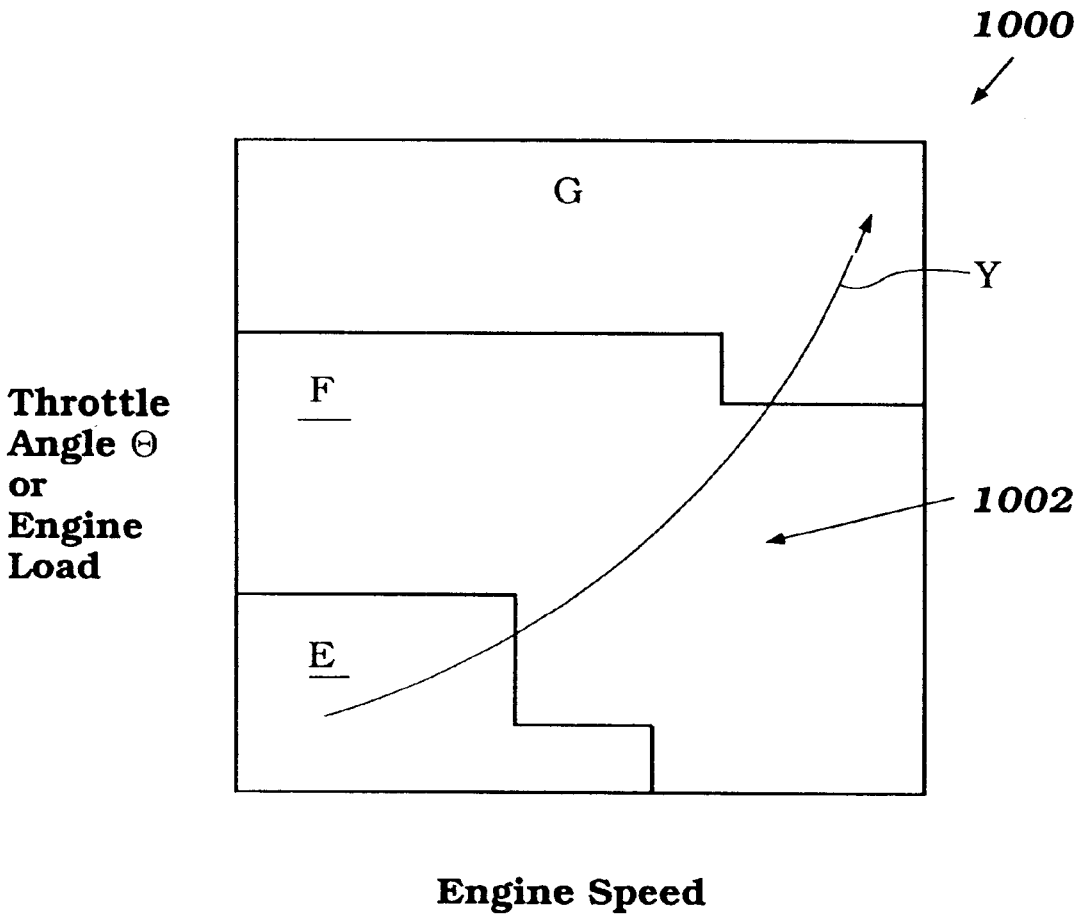
FIG. 10 illustrates an example map that can be used for determining load levels.

FIG. 10 illustrates an example map 1000 that can be used for determining load levels. The map depicts a space 1002 of possible values for engine speed (horizontal axis) and throttle angle (vertical axis). A load curve "Y" along which engine speed and throttle angle typically vary is also shown in the space 1002 for convenience. In the example map, the space 1002 is divided into three load frequency regions, "E, " "F, " and "G." Each region has a corresponding load coefficient, for example, 1.0 for "E, " 1.1 for "F, " and 1.2 for "G." The region "E" is a low load coefficient region in which engine operation leads to the supply of a standard amount of oil. The region "F" is a medium load coefficient region in which engine operation leads to the supply of an increased amount of oil. The region "G" is a high load coefficient region in which engine operation leads to the supply of an increased amount of oil.

To calculate a load frequency coefficient, the ECU 148 multiplies the operating time of the engine in each region by the corresponding load coefficient, sums the results and divides by the total operating time:

$$C1=\Sigma(\text{load coefficient}*\text{corresponding operating time})/\text{total operating time}.$$

For example, if an engine operates for 10 minutes in each of regions "E, " "F, " and "G" described above, the load coefficient would be:

$$C1=(1.0*10+1.1*10+1.2*10)/30=1.1$$

The ECU 148 then uses the calculated Cl to compensate the oil amount, AMT, for historical engine load. The compensation for load frequency can be performed for various periods of time. In a preferred embodiment, the load frequency is used to compensate the amount of oil delivered by multiplying the oil amount, AMT, by Cl as follows:

$$AMT=AMT*C1,$$

where the load frequency, C1, is calculated based upon the total history of the engine's operation. In another embodiment, the load frequency coefficient in the above assignment is only calculated for an engine's running session since it has been last started. In another embodiment, the load frequency coefficient is calculated over a moving time window. In still another embodiment, the load frequency coefficient is calculated during the break-in period and used to adjust the break-in coefficient, Cb, as follows:

$$AMT=AMT*((Cb-1)*C1+1).$$

At the step 616 of flowchart 600, the ECU 148 compensates the oil amount, AMT, supplied in step 614, for cylinder resting periods by multiplying the oil amount by a coefficient as follows:

$$AMT=AMT*Cr$$

Cr: Cylinder Resting Compensation Coefficient

Cr=f(engine speed, engine load, is cylinder resting?).

As is well known in the art, some engines employ resting periods for certain cylinders during idle or low power situations, or during abnormal running conditions (e.g. engine overheating). During a resting period, one or more cylinders of a multiple cylinder engine will not fire on each crankshaft revolution. The revolution during which a cylinder does not fire is known as a resting period. One method by which cylinder resting can be achieved in a fuel injected engine is to suspend injection to selected cylinders Another method by which cylinder resting can be achieved is through misfiring or adjusting the timing of the firing of the spark plugs for selected cylinders. During a cylinder resting period, a decreased oil charge is preferably delivered to the cylinder to prevent the generation of smoke.

At the step 618 of flowchart 600, the ECU 148 sends signals to the solenoid valve unit 150 to regulate the delivery of oil in accordance with the compensated oil amount, AMT, calculated in the step 616. In the first embodiment, the control maps and the compensated oil amount, AMT, specify the proportion of the amount of oil supplied by the oil pump 146 that is to be supplied to the cylinders by the solenoid valve unit 150. The oil pump 146 varies the amount of oil supplied to each solenoid valve 508 through the adjustment lever 310 based upon the angle of the throttle valve 148 and this variation is preferably already taken into account in the creation of the control maps. For example, if the resulting valve of AMT is equal to a proportion of 0.75, then during one cycle, the ECU 148 will leave the corresponding solenoid valve 508 off for 0.75 of the cycle and turn the solenoid valve on for 0.25 of the cycle. In this maimer the proportion equal to AMT of the oil supplied by the oil pump 146 is directed to the corresponding cylinder 122.

In the second embodiment, the oil supply amount, AMT, is made proportional to the actual quantity of oil supplied to the cylinders 122 rather than a proportion of the oil delivered by the oil pump 146. In step 618 in this case, the ECU 148 determines the proportion that the compensated oil amount, AMT, bears to the total amount of oil delivered by the oil pump 146. The total amount of oil delivered by the oil pump 146 may be determined based upon a control map or a formula, or in the alternative, a detector may be used to measure flow. The ECU 148 then activates each solenoid valve 508 based upon this proportion in a manner similar to the first embodiment. Other equivalent processes for determining the proportion or duration during which to activate the solenoid valves 508 will be apparent to those skilled in the art.

Figure 11:
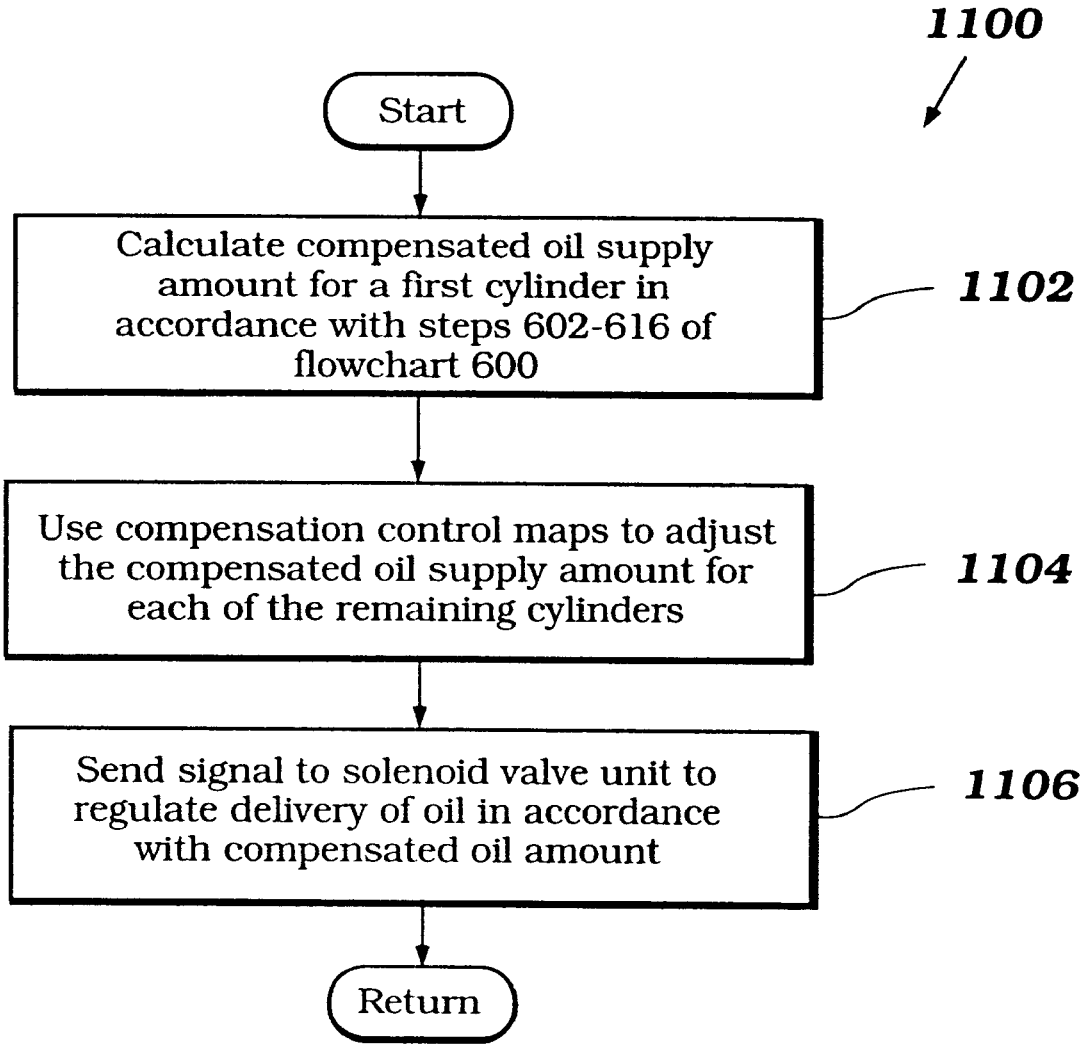
FIG. 11 illustrates a flowchart of another process in accordance with which the ECU can regulate the amount of oil delivered to each cylinder.
Figure 12:
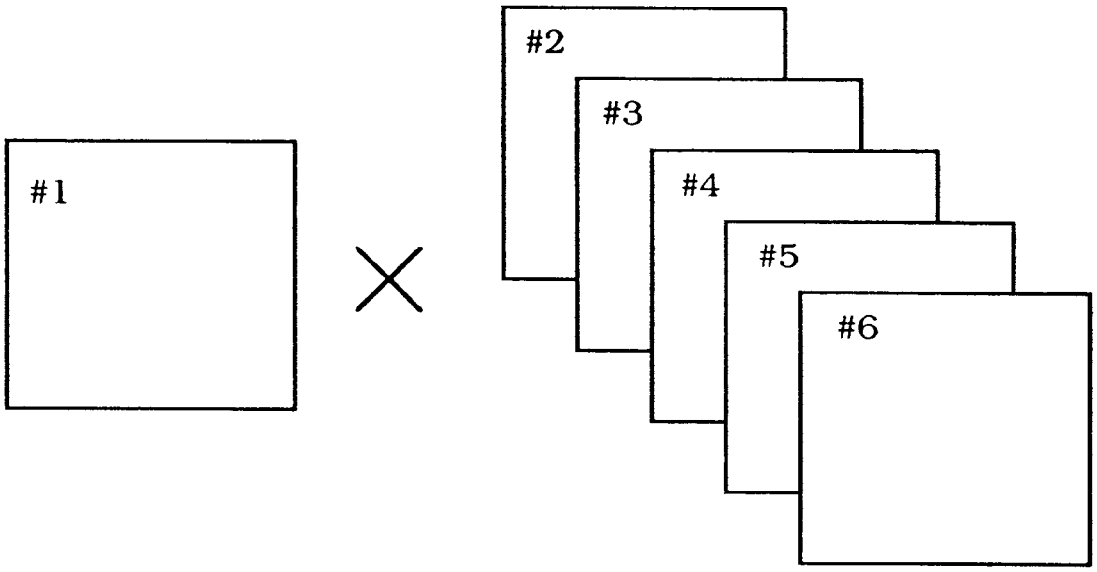
FIG. 12 graphically depicts the process illustrated in FIG. 11.

FIG. 11 illustrates a flowchart 1100 of an alternative process in accordance with which the ECU 148 can regulate or fine tune the amount of oil delivered to each cylinder 122. At a step 1102, the ECU 148 calculates the oil amount, AMT for a single cylinder preferably in accordance with steps 602–616 of flowchart 600. Then, at a step 1104, the ECU 148 uses compensation control maps to adjust the AMT for the remaining cylinders. Finally, the ECU 148 performs a step 1106, which is preferably similar to the step 618 of the flowchart 600, to send the appropriate signals to the solenoid valve unit 150. FIG. 12 graphically depicts the process of flowchart 1100.

Figure 13:
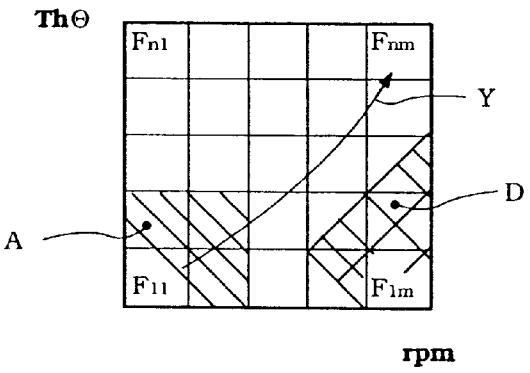
FIG. 13 illustrates five example compensation control maps for cylinders 2–6, in addition to a basic control map for cylinder 1.

FIG. 13 illustrates five example compensation control maps for cylinders 2–6, in addition to a basic control map for cylinder 1 as already illustrated in FIG. 7A. The compensated oil amount, AMT, is calculated at step 1102 using the basic control map for cylinder 1. The compensation control map for each remaining cylinder contains compensation values, based upon throttle angle and engine speed, by which the AMT value for cylinder 1 is multiplied in the step 1104 to determine the respective AMT for the cylinder. For example, for the second cylinder:

$$AMT\#2 = AMT * Map\#2 \text{ at (engine speed, throttle angle).}$$

In the example maps, the bottom cylinders 5 and 6 have generally lower coefficients than the top cylinders since they are exposed to more coolant and require less oil. During rapid deceleration periods, trolling periods and idle periods, the bottom cylinders receive lubricant draining down from top cylinders and accordingly are delivered even less oil as shown in the bottom rows of maps 5 and 6.

Figure 14:
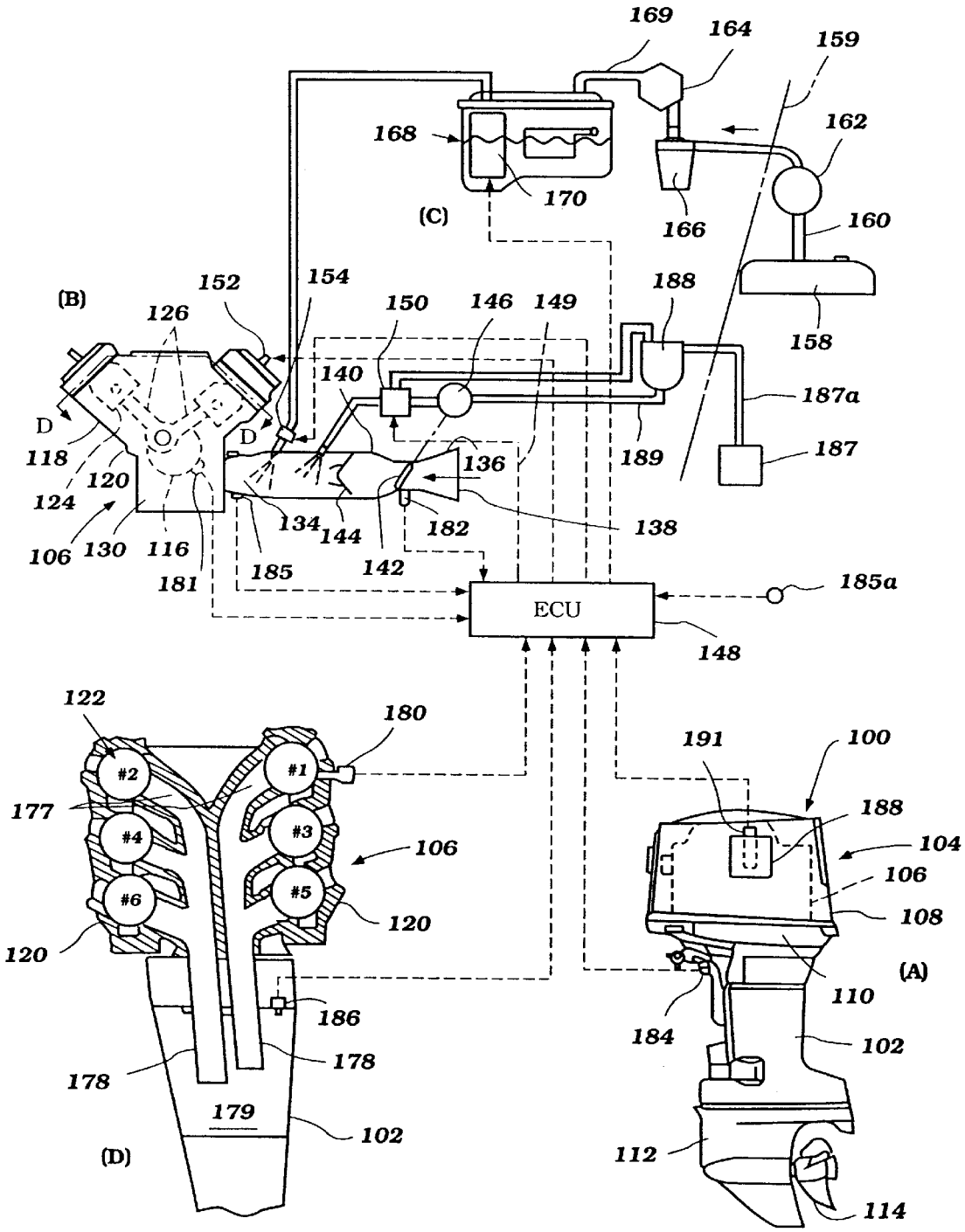
FIG. 14 illustrates a schematic of an additional embodiment of the present invention in which a fuel injector is provided in an intake passage, as opposed to the direct injection system illustrated in FIG. 1.

FIG. 14 illustrates a schematic of an another embodiment of the present invention. The embodiment comprises a two-cycle multiple cylinder engine 106 similar to the embodiment illustrated in FIG. 1. In this embodiment, however, a fuel injector 154 is provided in the intake port 134. In another mode, fuel could be supplied by a carburetor instead of using a fuel injector. In still another mode, the oil pump 146 could supply oil to the vapor separator 168 for mixture with the fuel, wherein oil is supplied to the cylinders through the fuel injection or carburetion system. The delivery of fuel is controlled depending on intake air volume and therefore the delivery of oil to the cylinders is also controlled.

FIGS. 15A–H show eight exemplary timing diagrams for controlling the solenoid valve unit 150 in order to deliver an appropriate amount of oil to the cylinders 122. Representations of these timing diagrams are preferably integrated into the control map and stored into a memory of the control system with which the ECU 148 communicates. The ECU 148 controls the operation of the individual valves of the solenoid valve unit 150 based upon the stored control maps.

At the top of each timing diagram is a reference signal that has pulses at 60° crankshaft rotation increments. These timing signals can be produced by the crankshaft sensor 181 reading marks placed at 60° intervals about the flywheel 224. The timing lines are numbered 1 through 6 and correspond to the opening of the solenoid valves 508 that regulate oil delivery to the air induction systems 132 associated with the cylinders as follows: lines 1 and 2 correspond to the top two cylinders 1 and 2, lines 3 and 4 correspond to the middle two cylinders 3 and 4, and lines 5 and 6 correspond to the bottom two cylinders 5 and 6. The timing lines indicate an open solenoid valve sending oil to the cylinder when high, and indicate a closed solenoid valve redirecting oil to the main oil tank 188 when low. The timing lines are also illustrative of the control signals that would be produced by the ECU 148 and passed through the drive signal lines 149 to the solenoid valve unit 150. In this regard, however, a low timing line is indicative of an active signal and a high timing line is indicative of an inactive signal. This is the case since an active signal from the ECU 148 to the solenoid valve 508 cuts off oil flow to the cylinder 122 in the preferred embodiment. Other configurations could, however, be used to suit other applications.

Figure 15A:
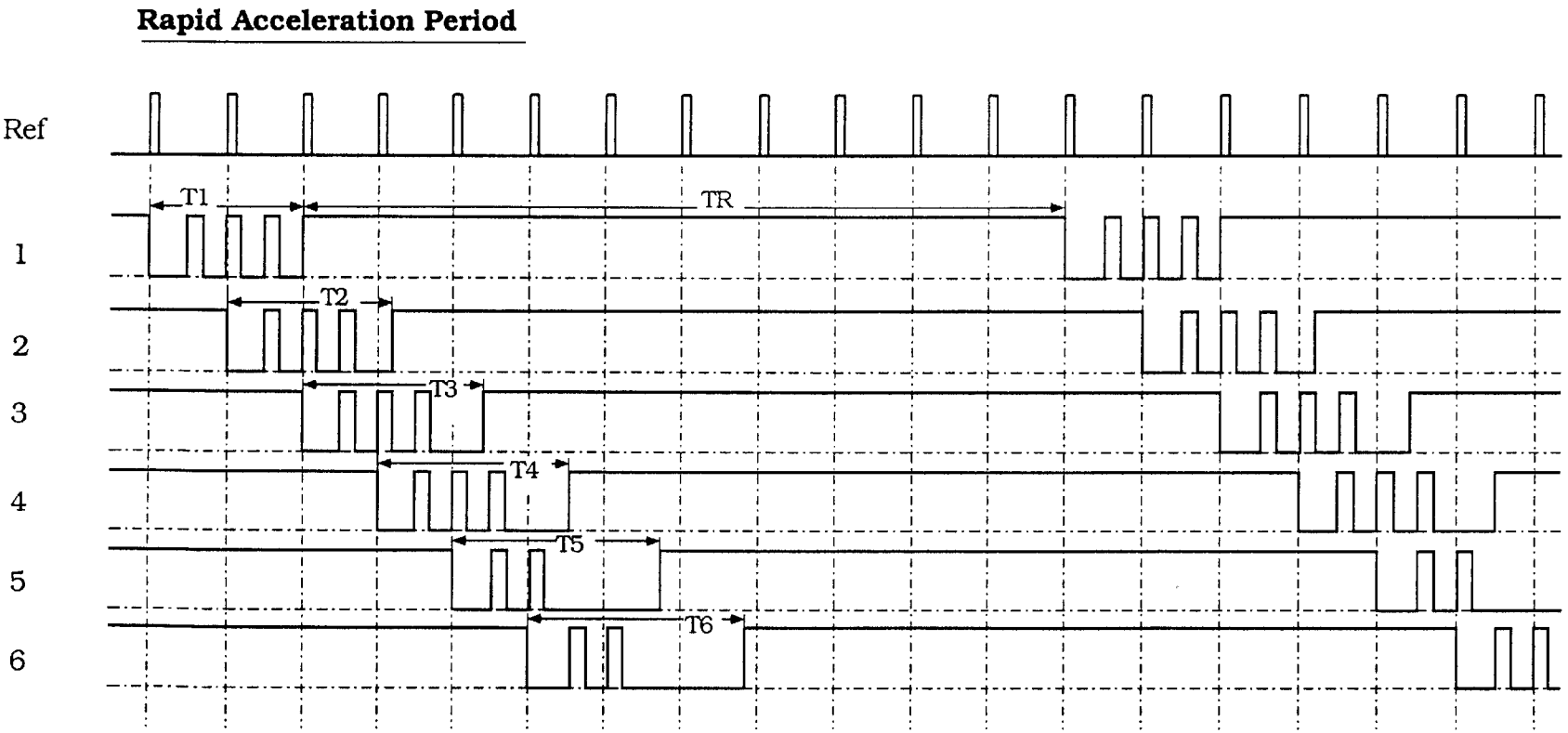
FIGS. 15A–H show eight exemplary timing diagrams for controlling the solenoid valve unit in order to deliver a predetermined amount of oil to the cylinders depending upon the engine's running condition.

FIG. 15A illustrates a timing diagram that is preferably used under conditions of rapid acceleration. The indicating reference TR indicates a resting time for the solenoid valve 508 during which it is not carrying current and is open, supplying oil to the respective cylinder. The indicating references T1–T6 indicate the time periods during which each of the solenoid valves 508 are activated to intermittently switch off oil supply to the respective cylinders 122. In the preferred embodiment, the time periods during which oil is intermittently switched off commence contemporaneously with the ticks on the reference signal. In this manner, the switching off time periods can be synchronized with the same point in the combustion cycle for each cylinder 122. Note that the total off time increases gradually from the top cylinder 1 to the bottom cylinder 6. This delivery scheme is in accordance with the higher oil volume requirements of the top cylinders. During the periods T1–T4 the oil flow is intermittently switched back on three times for the top and middle cylinders. During the periods T5–T6 the oil flow is only switched on twice for the two lower cylinders. Note that the intermittent switching off periods only occur during every second crankshaft revolution as the next off period for cylinder 1 is twelve reference ticks from its first.

As illustrated in FIG. 15A, the oil supply is switched off for a first duration that is the same for each cylinder. The oil supply is then switched on for a second duration that is the same for each cylinder. Next, the oil supply is again switched off for a third duration that is the same for each cylinder. Next, the oil supply is switched on again for a fourth duration that is the same for each cylinder. Next, for cylinders 1 through 4, the oil supply is again switched off and on for fifth and sixth durations that are the same for each cylinder. Next, for cylinders 1 through 4, the oil supply is switched off for a duration that increases gradually from cylinders 1 to 4 in accordance with the lesser oil requirements of the lower cylinders. Finally, for cylinders 1 to 4, the oil supply is switched on again until the end of the cycle. For cylinders 5 and 6, after the fourth duration, the oil supply is switched off again for a duration that is less for cylinder 5 and greater for cylinder 6. Finally, for cylinders 5 and 6, the oil supply is switched on again until the end of the cycle.

Figure 15B:
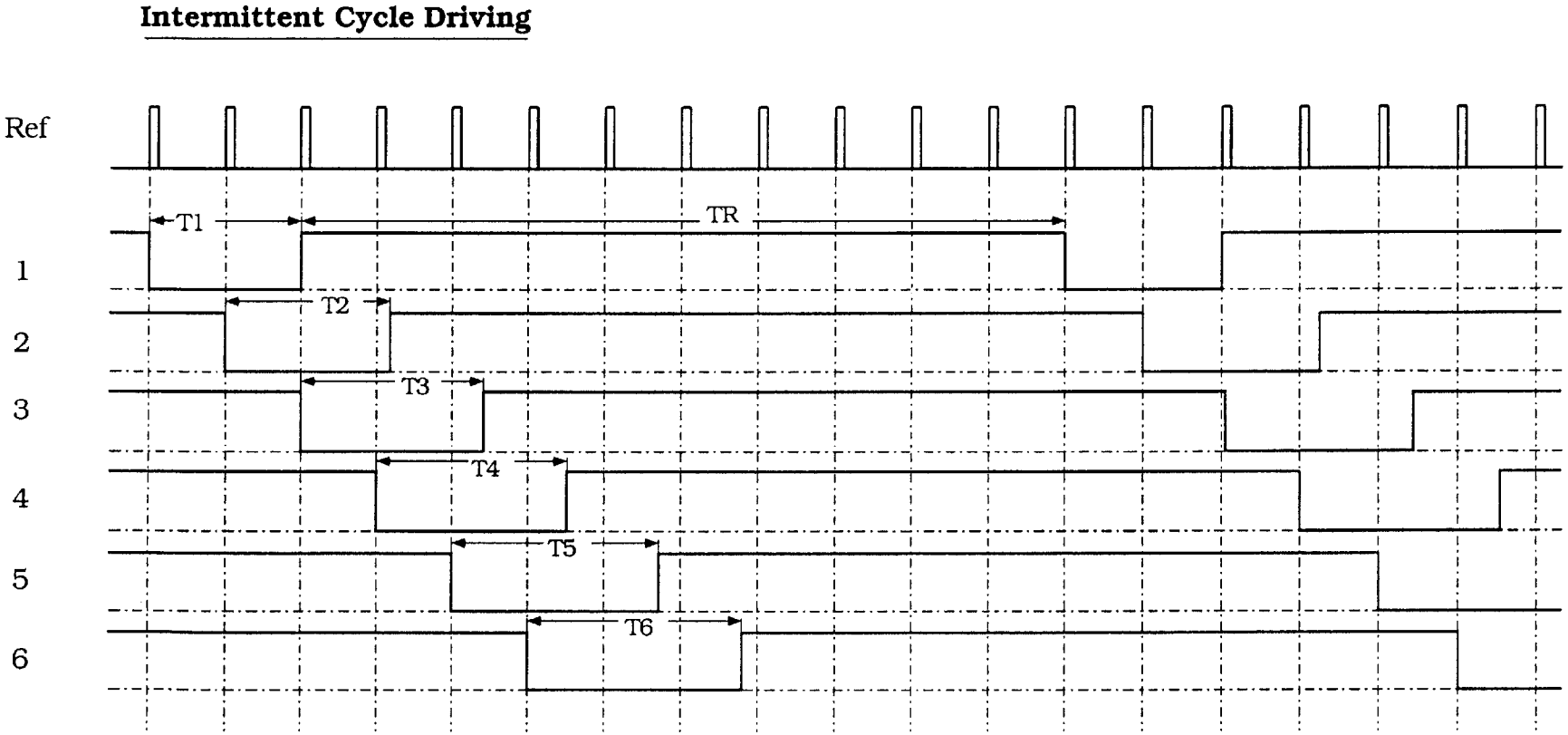

FIG. 15B illustrates a second timing diagram in which the periods T1–T6 represent a constant shutoff of oil flow to the respective cylinder during the duration. The diagram is titled "Intermittent Cycle Driving" as the solenoids are only activated on intermittent or alternate crankshaft revolutions. The period of the off time increases gradually from the top cylinder 1 to the bottom cylinder 6 in accordance with the higher oil requirements of the upper cylinders.

Figure 15C:
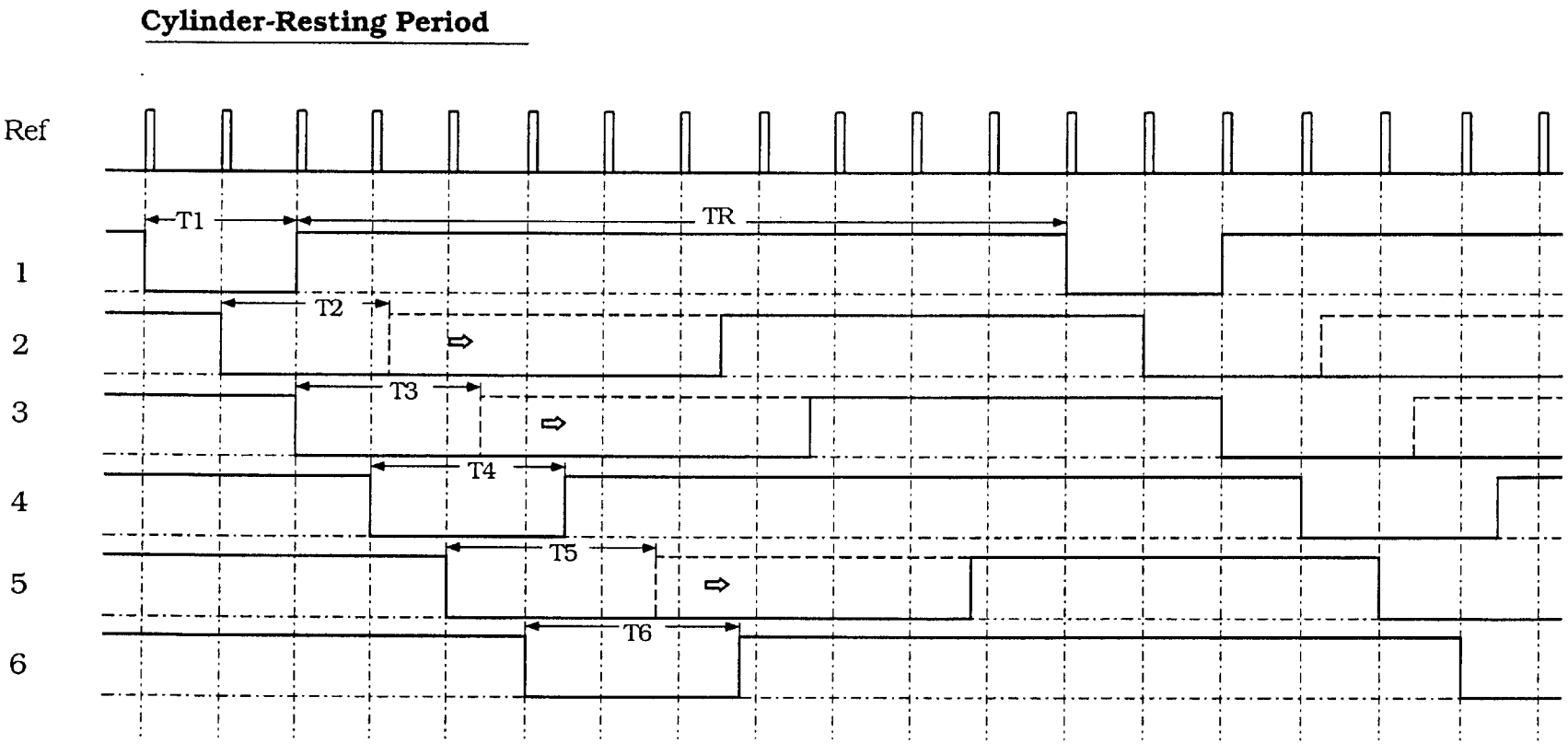

The timing diagram of FIG. 15C is similar to that of FIG. 15B; however, it illustrates a timing scenario that can be used in conjunction with cylinder "resting" periods. In the timing diagram depicted in FIG. 15C, cylinders 2, 3, and 5 are in resting periods. During a resting period, a cylinder typically requires less oil than during a normal crankshaft revolution. The timing diagram, therefore, depicts an increased duration during which the oil flow to cylinders 2, 3, and 5 is switched off. The difference between the normal on duration, as indicated in phantom, and the "resting" on duration is identified by a small arrow in the timing lines of cylinders 2, 3, and 5.

Figure 15D:
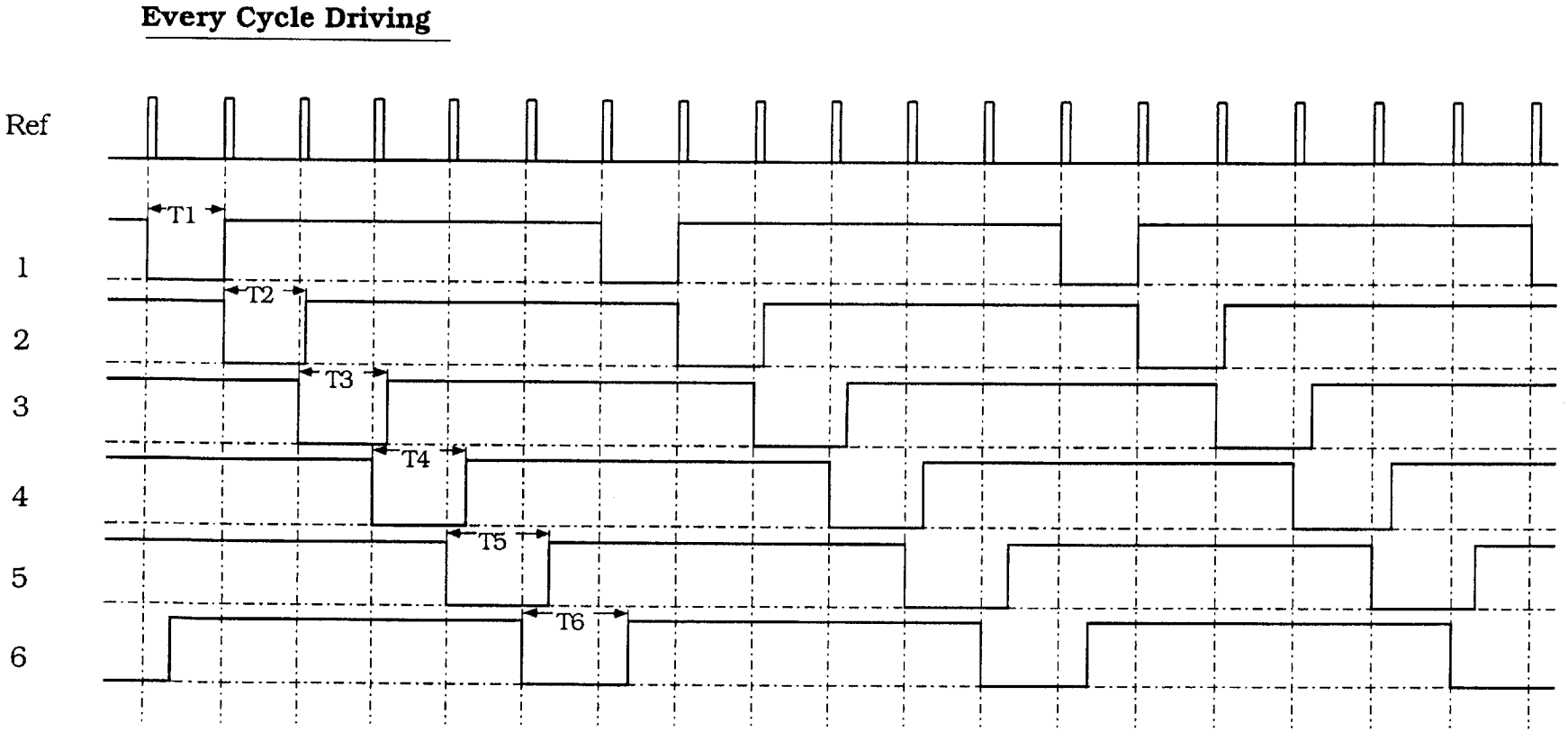

The timing diagram of FIG. 15D is also similar to that of FIG. 15B; however, the solenoid valves 508 shut off the oil flow once during each crankshaft revolution, but for a shorter duration of time. Accordingly the diagram is titled "Every Cycle Driving" to indicate that the solenoid valves are driven every crankshaft revolution. As in the timing diagram of FIG. 15B, the off period is greater for the lower cylinders.

Figure 15E:
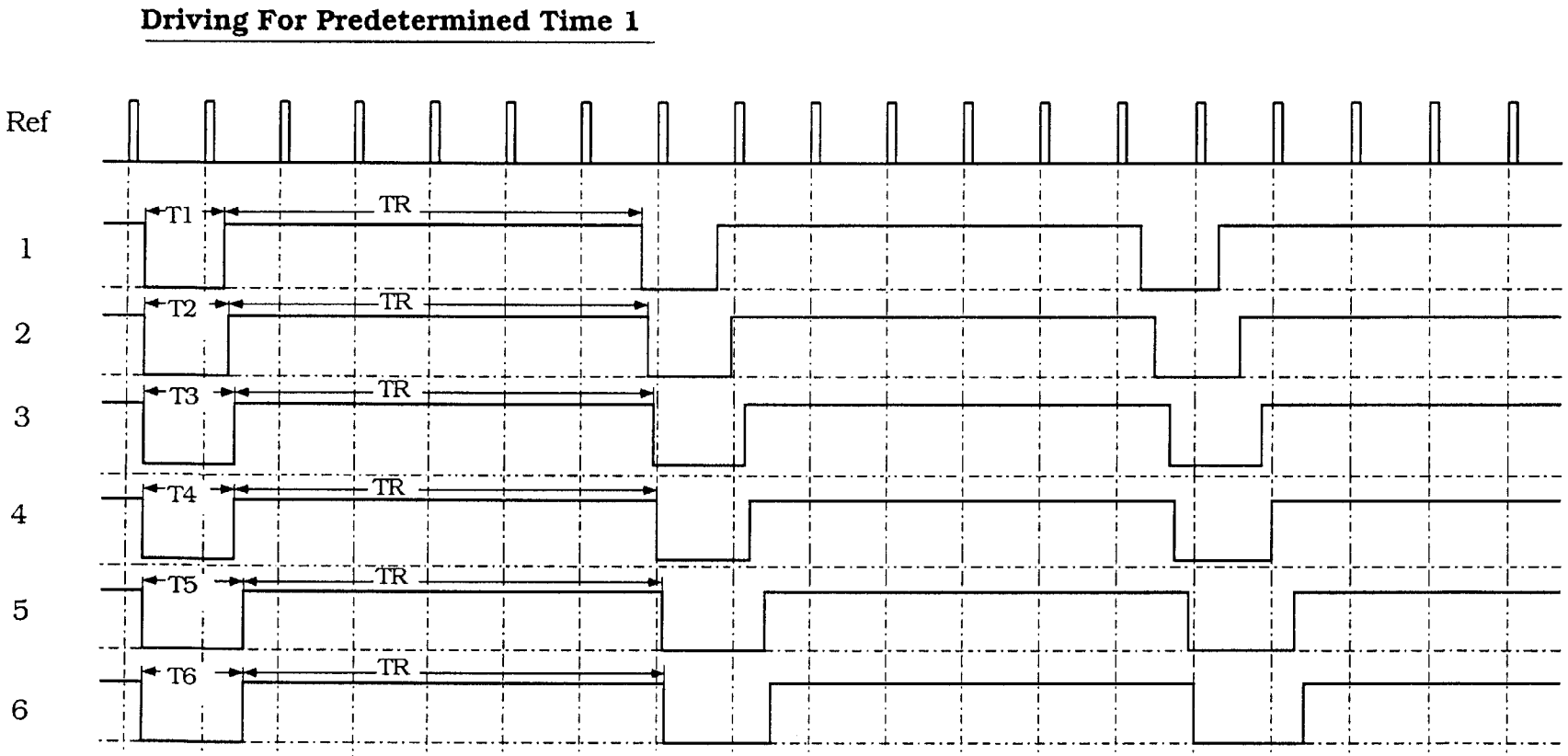

FIG. 15E illustrates a timing diagram titled "Driving for Predetermined Time 1" in which the shutoff periods are not necessarily synchronized with the turning of the crankshaft or a reference signal. In this timing diagram each cylinder has a respective off period, T1–T6, which is greater for the lower cylinders. The on period, TR, however, is the same for each cylinder. Accordingly, the on-off cycle time for the lower cylinders is greater than that of the upper cylinders. One method by which this timing scenario could be implemented involves the use of timers that are alternately reset to count down an off period (one of T1–T6) and the on period (TR). The on-off cycle time for certain cylinders in this case will likely not correspond to a whole number of crankshaft revolutions. In an additional embodiment, the on period could also be varied for the various cylinders.

Figure 15F:
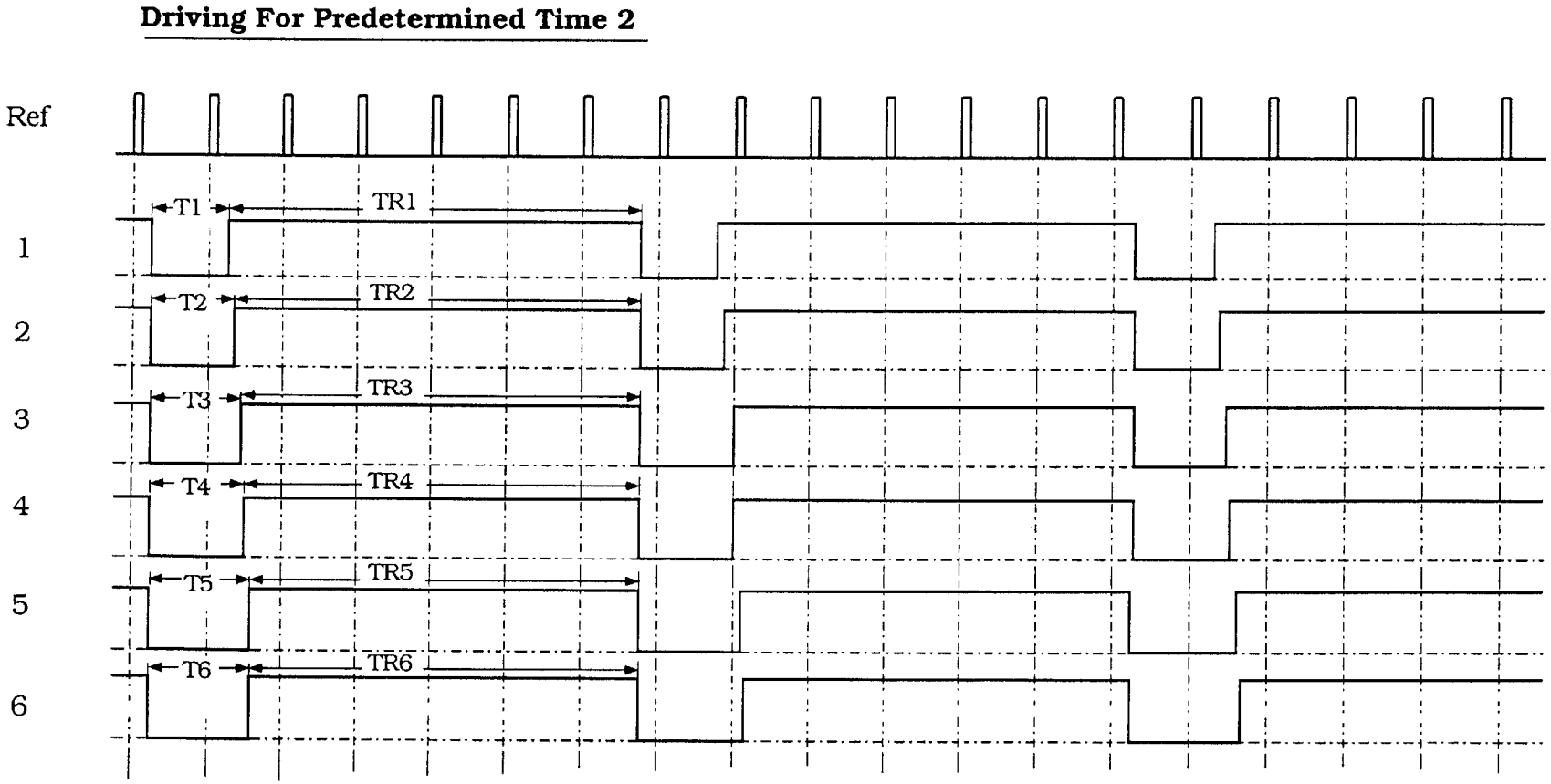

FIG. 15F illustrates a timing diagram titled "Driving for Predetermined Time 2" in which, like the previous diagram, the shutoff periods are not necessarily synchronized with the reference signal. Unlike the previous diagram, however, the cycle periods are the same for all cylinders. The sum of the off duration, T1–T6, and the on duration TR1–TR6, therefore, is the same for each cylinder. The upper cylinders have a shutoff duration that occupies a lesser portion of the period than the lower cylinders. Accordingly, more oil is delivered to the upper cylinders. In this timing diagram, the shutoff period also begins substantially at the same time for each cylinder. Therefore, the shutoff period may occupy a different portion of the two stroke cycle for each cylinder. One method by which this timing scenario could be implemented involves the use of timers that are alternately reset to count down an off period (one of T1–T6) and an on period (one of TR1–TR6).

Figure 15G:
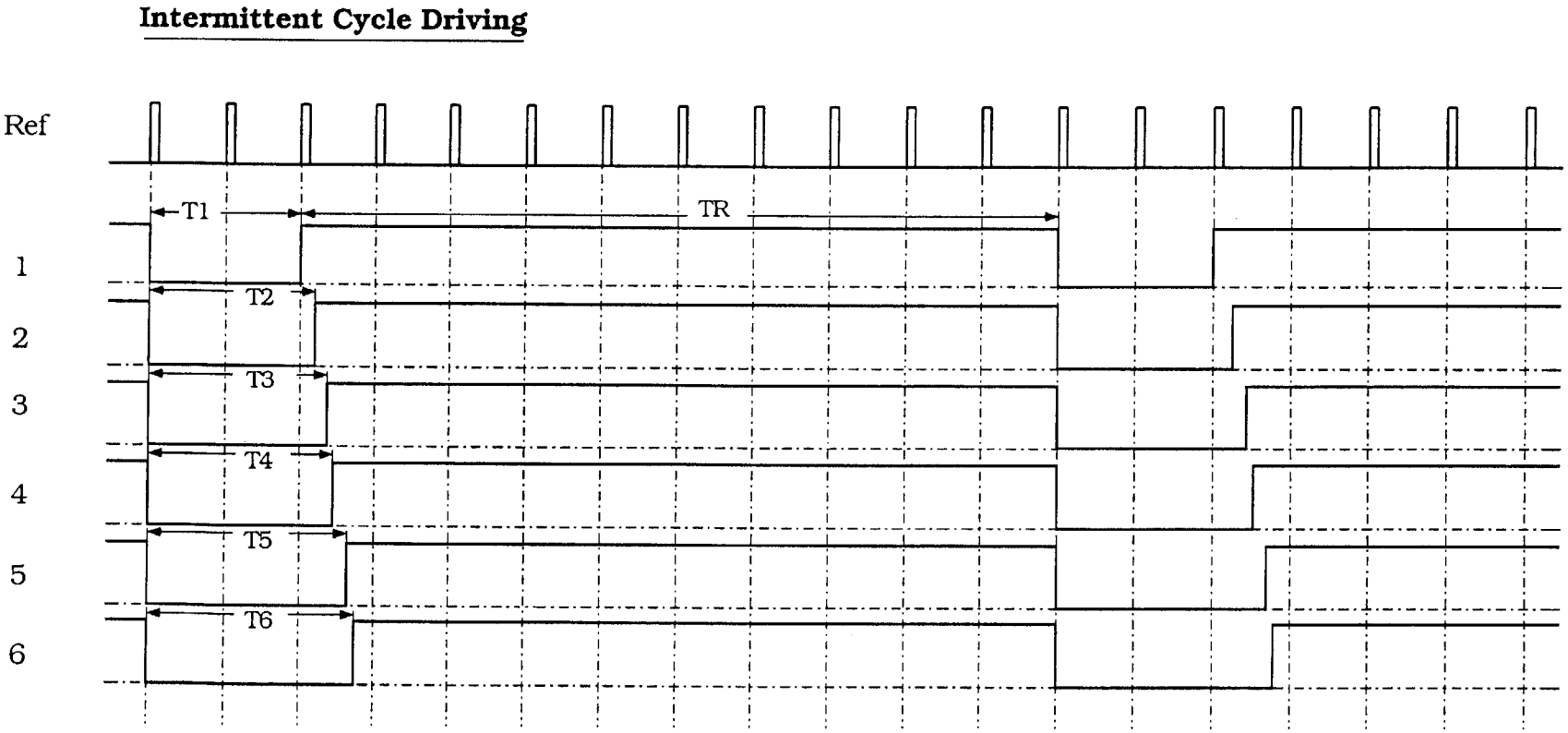

FIG. 15G illustrates a timing diagram that is similar to FIG. 15F; however, the beginning of the shutoff duration is synchronized with the reference signal. The shutoff duration is also longer and occurs less frequently. Accordingly the diagram is titled "Intermittent Cycle Driving." This timing diagram is an alternative to that of FIG. 15F that delivers approximately the same amount of oil using less frequent shutoff periods.

Figure 15H:
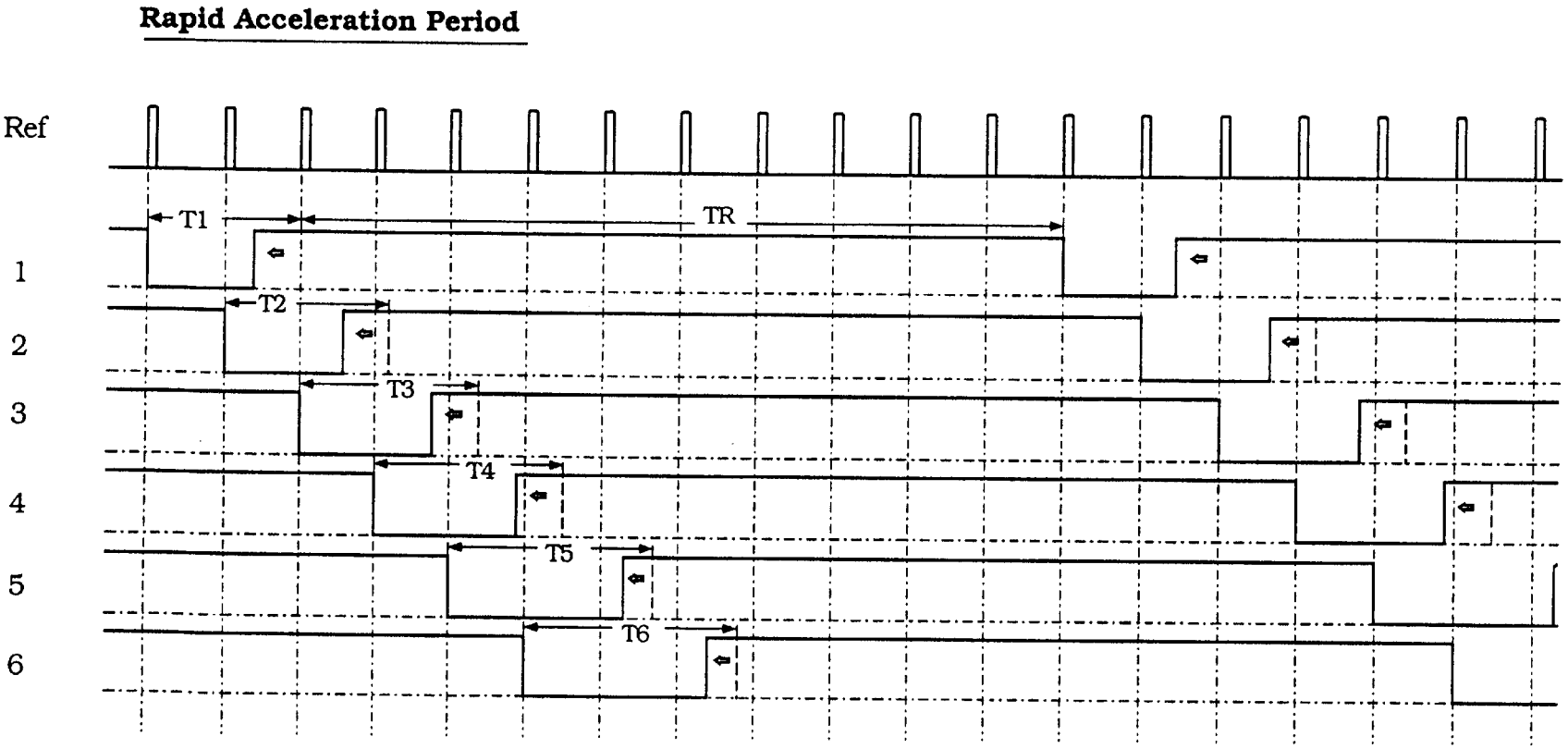

FIG. 15H illustrates a timing diagram that is similar to FIG. 15B; however, the off periods are adjusted to provide an increased amount of oil under conditions of rapid acceleration. The normal periods of oil supply are indicated by phantom lines, while the increased oil supply under rapid acceleration is indicated by solid lines. An arrow also indicates the added duration of oil supply for each cylinder.

Figure 16:
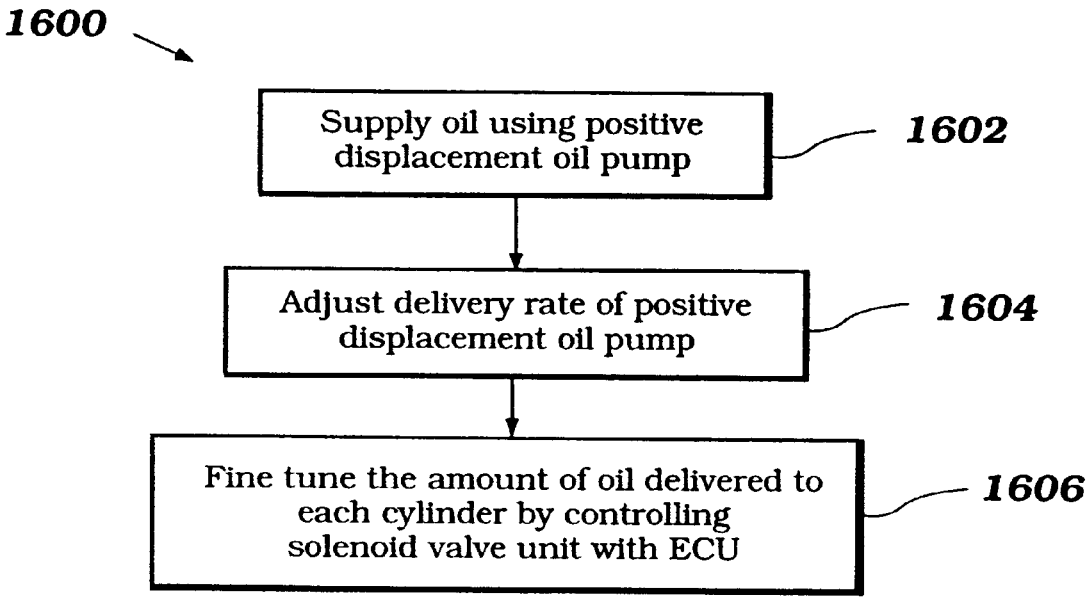
FIG. 16 illustrates a flowchart of a general embodiment of a process for supplying lubrication oil to an engine in accordance with the present invention.

FIG. 16 illustrates a flowchart 1600 of a general embodiment of a process for supplying lubrication oil to an engine in accordance with the present invention. At a step 1602, oil is supplied using a positive displacement type oil pump. At a step 1604, the delivery rate of the positive displacement oil pump is adjusted. Step 1604 can comprise using an adjustment lever connected to a throttle linkage to vary the volume of oil supplied per crankshaft revolution by the pump. Alternatively, step 1604 can comprise using an adjustment lever that is actuated based upon a control signal from an ECU. The control signal from the ECU can adjust the volumetric flow from the pump in accordance with a number of parameters such as engine speed, throttle angle, engine load, air temperature, atmospheric pressure, etc. In one embodiment, the processes illustrated in flowcharts 600 or 1100, or portions thereof can be used by the ECU to control the adjustment lever of the pump. For example, the ECU 148 can control the volume of oil delivered by the oil pump 146 through an electronic control of the adjustment lever in accordance with steps 1102–1104 of flowchart 1100. In this case many of the adjustments or compensations that apply to all of the cylinders can be performed by adjusting the volume supplied by the variable volume pump 146, rather than through the solenoid valve unit 150.

At a step 1606, the ECU controls a solenoid valve unit to fine tune the amount of oil delivered to each cylinder of the engine. In the preferred embodiment, the amount of oil delivered to one cylinder may differ from the amount of oil delivered to another cylinder depending on engine conditions. The step 1606 can comprise the processes illustrated in flowcharts 600 or 1100, or portions thereof, such as, for example, step 1106 of the flowchart 1100.

While certain exemplary preferred embodiments, and variations thereof, have been described and shown in the accompanying drawings, it is to be understood that such embodiments are merely illustrative of and not restrictive on the broad invention. Further, it is to be understood that this invention shall not be limited to the specific construction and arrangements shown and described since various modifications or changes may occur to those of ordinary skill in the art without departing from the spirit and scope of the invention as claimed. For instance, the present lubrication injection and control system can be used with two-cycle engines employed in applications other than outboard motors, as well as with engines operating on other than a two-cycle combustion principle. It is intended that the scope of the invention be limited not by this detailed description but by the claims appended hereto. In the method claims, reference characters are used for convenience of description only, and do not indicate a particular order for performing the method.

What is claimed is:

1. A lubrication system for a two-cycle engine having a plurality of cylinders, the system comprising:

a positive displacement oil pump configured to supply oil;

a solenoid valve unit configured to receive oil supplied by the positive displacement oil pump, the solenoid valve unit comprising a plurality of solenoid valves, each solenoid valve being configured to regulate a flow of oil from the positive displacement oil pump to one of the cylinders; and an electronic control unit configured to control the solenoid valve unit to regulate the flow of oil to a first of the plurality of cylinders differently than the flow of oil to a second of the plurality of cylinders.

2. The lubrication system of claim 1, wherein the electronic control unit regulates the flow of oil to the first of the plurality of cylinders based at least upon a first control map and wherein the electronic control unit regulates the flow of oil to the second of the plurality of cylinders based at least upon a second control map that is not used to regulate the flow of oil to the first of the plurality of cylinders.

3. The lubrication system of claim 2, wherein the first control map defines, as a function of at least one engine operation factor, proportion of the oil supplied by the oil pump that is to be delivered to the first cylinder.

4. The lubrication system of claim 2, wherein the first control map defines, as a function of at least one engine operation factor, volume of oil that is to be delivered to the first cylinder.

5. The lubrication system of claim 2, wherein the first control map defines, as a function of at least one engine operation factor, value proportional to the volume of oil to be delivered to the first cylinder.

6. The lubrication system of claim 2, wherein the first control map is a function of at least engine speed.

7. The lubrication system of claim 6, wherein the first control map is also a function of throttle position.

8. A method of determining an oil amount for a two-cycle engine, the method comprising:

(A) determining engine speed and throttle position;

(B) determining a basic oil amount for a first cylinder based upon a respective control map that defines the basic oil amount as a function of engine speed and throttle position; and (C) compensating the oil amount for the first cylinder based upon a function of at least one engine operation factor, wherein the engine operation factor is an induction air temperature, an atmospheric pressure, a battery voltage, an engine break-in period, a cylinder resting period, a load frequency coefficient, or a sensor failure.

9. The method of claim 8, further comprising repeating (B) and (C) for at least one additional cylinder.

10. The method of claim 8, wherein the oil amount for the first cylinder is compensated based upon at least induction air temperature.

11. The method of claim 8, wherein the oil amount for the first cylinder is compensated based upon at least atmospheric pressure.

12. The method of claim 8, wherein the oil amount for the first cylinder is compensated based upon at least battery voltage.

13. The method of claim 8, wherein the oil amount for the first cylinder is compensated based upon at least an engine break-in period.

14. The method of claim 8, wherein the oil amount for the first cylinder is compensated based upon at least cylinder resting periods.

15. The method of claim 8, wherein the oil amount for the first cylinder is compensated based upon at least a load frequency coefficient.

16. The method of claim 8, wherein the oil amount for the first cylinder is compensated based upon at least a sensor failure.

17. The method of claim 8, further comprising using compensation control maps to adjust the compensated oil amount for at least one additional cylinder.

18. A lubrication system for controlling oil delivery to the cylinders of an engine, the system comprising:

means for supplying oil at a base rate;

means for adjusting the base rate in relation to a throttle position to deliver an adjusted rate; and means for fine tuning the adjusted rate for each of a first and second cylinders to deliver a fine tuned rate to each of the first and second cylinders, wherein the fine tuned rate is different for the first cylinder than the fine tuned rate for the second cylinder.

19. A lubrication system for a two-cycle internal combustion engine, the lubrication system comprising:

a positive displacement oil pump configured to supply oil;

a solenoid valve unit configured to receive oil supplied by the positive displacement oil pump, the solenoid valve unit comprising at least one solenoid valve each solenoid valve being configured to regulate a flow of oil from the positive displacement oil pump to a cylinder; and an electronic control unit configured to control the solenoid valve unit to regulate the flow of oil based at least upon an engine operation factor, wherein the engine operation factor is an induction air temperature, an atmospheric pressure, a battery voltage, an engine break-in period, a cylinder resting period, a load frequency coefficient, or a sensor failure.

20. The lubrication system of claim 19, wherein the engine operation factor is an induction air temperature.

21. The lubrication system of claim 19, wherein the engine operation factor is an atmospheric pressure.

22. The lubrication system of claim 19, wherein the engine operation factor is a battery voltage.

23. The lubrication system of claim 19, wherein the engine operation factor is an engine break-in period.

24. The lubrication system of claim 19, wherein the engine operation factor is a cylinder resting period.

25. The lubrication system of claim 19, wherein the engine operation factor is a load frequency coefficient.

26. The lubrication system of claim 19, wherein the engine operation factor is a sensor failure.

27. A method of delivering lubrication oil to a plurality of cylinders of a two-cycle engine, the method comprising:

delivering oil to a first cylinder at a first rate; and delivering oil to a second cylinder at a second rate, wherein the second rate is different than the first rate, and wherein the difference between the first rate and the second rate is based upon at least one engine operating condition.

28. The method of claim 27, wherein the at least one engine operating condition comprises engine speed.

29. The method of claim 27, wherein the at least one engine operating condition comprises throttle position.

* * * * *